US008677882B2

(12) United States Patent
Shackelford et al.

(10) Patent No.: US 8,677,882 B2
(45) Date of Patent: Mar. 25, 2014

(54) VEHICLE AND STRUCTURE SHIELD WITH FLEXIBLE FRAME

(75) Inventors: Justin Trent Shackelford, Milford, MA (US); Robert G. Holmes, Jr., Berlin, MA (US)

(73) Assignee: QinetiQ North America, Inc., Reston, VA (US)

( * ) Notice: Subject to any disclaimer, the term of this patent is extended or adjusted under 35 U.S.C. 154(b) by 43 days.

(21) Appl. No.: 13/586,456

(22) Filed: Aug. 15, 2012

(65) Prior Publication Data

US 2013/0032026 A1 Feb. 7, 2013

Related U.S. Application Data

(63) Continuation-in-part of application No. 13/373,408, filed on Nov. 14, 2011, now Pat. No. 8,464,627, which is a continuation-in-part of application No. 13/065,790, filed on Mar. 30, 2011, now Pat. No. 8,245,620, which is a continuation-in-part of application No. 12/807,532, filed on Sep. 8, 2010.

(51) Int. Cl.
*F41H 7/02* (2006.01)

(52) U.S. Cl.
USPC ..... 89/36.08; 89/36.04; 89/36.09; 89/920; 89/929; 89/939

(58) Field of Classification Search
USPC ..... 89/36.01, 36.02, 36.04, 36.08, 36.09, 89/36.12, 902, 920, 929, 930; 403/203, 403/220, 223, 291
See application file for complete search history.

(56) References Cited

U.S. PATENT DOCUMENTS

| | | | |
|---|---|---|---|
| 1,198,035 | A | 9/1916 | Huntington |
| 1,204,547 | A | 11/1916 | Corrado et al. |
| 1,229,421 | A | 6/1917 | Downs |
| 1,235,076 | A | 7/1917 | Stanton |
| 1,274,624 | A | 8/1918 | Steinmetz |
| 1,367,249 | A | 2/1921 | Goodyear |
| 1,385,897 | A | 7/1921 | Tresidder |
| 1,552,269 | A | 9/1925 | Brocker |
| 2,238,779 | A | 4/1941 | Mosebach |
| 2,296,980 | A | 9/1942 | Carmichael |
| 2,308,683 | A | 1/1943 | Forbes |

(Continued)

FOREIGN PATENT DOCUMENTS

| | | |
|---|---|---|
| DE | 691067 | 5/1940 |
| DE | 2206404 | 8/1973 |

(Continued)

OTHER PUBLICATIONS

Written Opinion of the International Searching Authority mailed May 1, 2012 for International Application No. PCT/US2012/00172, three (3) pages, unnumbered.

(Continued)

*Primary Examiner* — Stephen M Johnson
*Assistant Examiner* — Joshua Freeman
(74) *Attorney, Agent, or Firm* — Iandiorio Teska & Coleman LLP

(57) ABSTRACT

A protection system includes a net with lines connected at nodes and hard points attached to at least select nodes. A frame supports the net and positions it in a spaced relationship with respect to a vehicle or structure. The frame preferably includes select adjacent tubular members connected via a flexure to prevent damage to the frame when impacted.

29 Claims, 21 Drawing Sheets

(56) References Cited

U.S. PATENT DOCUMENTS

| | | | |
|---|---|---|---|
| 2,322,624 | A | 6/1943 | Forbes |
| 3,608,034 | A | 9/1971 | Bramley et al. |
| 3,633,936 | A | 1/1972 | Huber |
| 3,656,790 | A | 4/1972 | Truesdell |
| 3,656,791 | A | 4/1972 | Truesdell |
| 3,733,243 | A | 5/1973 | Crawford |
| 3,893,368 | A | 7/1975 | Wales, Jr. |
| 3,950,584 | A | 4/1976 | Bramley |
| 3,992,628 | A | 11/1976 | Karney |
| 4,051,763 | A | 10/1977 | Thomanek |
| 4,157,411 | A | 6/1979 | Thomson |
| 4,253,132 | A | 2/1981 | Cover |
| 4,262,595 | A | 4/1981 | Longerich |
| 4,358,984 | A | 11/1982 | Winblad |
| 4,399,430 | A | 8/1983 | Kitchen |
| 4,411,462 | A | 10/1983 | Buehrig et al. |
| 4,688,024 | A | 8/1987 | Gadde |
| 4,768,417 | A | 9/1988 | Wright |
| 4,912,869 | A | 4/1990 | Govett |
| 4,928,575 | A | 5/1990 | Smirlock et al. |
| 4,950,198 | A | 8/1990 | Repko, Jr. |
| 5,007,326 | A | 4/1991 | Gooch, Jr. et al. |
| 5,025,707 | A | 6/1991 | Gonzalez |
| 5,069,109 | A | 12/1991 | Lavan, Jr. |
| 5,078,117 | A | 1/1992 | Cover |
| 5,094,170 | A | 3/1992 | Raynaud et al. |
| 5,170,690 | A | 12/1992 | Smirlock et al. |
| 5,191,166 | A | 3/1993 | Smirlock et al. |
| 5,279,199 | A | 1/1994 | August |
| 5,291,715 | A | 3/1994 | Basile |
| 5,333,532 | A | 8/1994 | Smirlock et al. |
| 5,342,021 | A | 8/1994 | Watson |
| 5,370,035 | A | 12/1994 | Madden, Jr. |
| 5,394,786 | A | 3/1995 | Gettle et al. |
| 5,400,688 | A | 3/1995 | Eninger et al. |
| 5,435,226 | A | 7/1995 | McQuilkin |
| 5,441,239 | A | 8/1995 | Watson |
| 5,524,524 | A | 6/1996 | Richards et al. |
| 5,578,784 | A | 11/1996 | Karr et al. |
| 5,583,311 | A | 12/1996 | Rieger |
| 5,609,528 | A | 3/1997 | Kehoe |
| 5,622,455 | A | 4/1997 | Anderson et al. |
| 5,646,613 | A | 7/1997 | Cho |
| 5,705,058 | A | 1/1998 | Fisher |
| 5,725,265 | A | 3/1998 | Baber |
| 5,739,458 | A | 4/1998 | Girard |
| 5,750,918 | A | 5/1998 | Mangolds et al. |
| 5,792,976 | A | 8/1998 | Genovese |
| 5,842,939 | A | 12/1998 | Pui et al. |
| 5,898,125 | A | 4/1999 | Mangolds et al. |
| 5,924,723 | A | 7/1999 | Brantman et al. |
| 5,988,036 | A | 11/1999 | Mangolds et al. |
| 6,029,558 | A | 2/2000 | Stevens et al. |
| 6,119,574 | A | 9/2000 | Burkey et al. |
| 6,128,999 | A | 10/2000 | Sepp et al. |
| 6,279,449 | B1 | 8/2001 | Ladika et al. |
| 6,282,860 | B1 | 9/2001 | Ramirez |
| 6,311,605 | B1 | 11/2001 | Kellner et al. |
| 6,325,015 | B1 | 12/2001 | Garcia et al. |
| 6,374,565 | B1 | 4/2002 | Warren |
| 6,375,251 | B1 | 4/2002 | Taghaddos |
| 6,394,016 | B2 | 5/2002 | Swartout et al. |
| 6,499,796 | B1 | 12/2002 | Eenhoorn |
| 6,595,102 | B2 | 7/2003 | Stevens et al. |
| 6,626,077 | B1 | 9/2003 | Gilbert |
| 6,672,220 | B2 | 1/2004 | Brooks et al. |
| 6,782,792 | B1 | 8/2004 | Edberg et al. |
| 6,805,035 | B2 | 10/2004 | Edberg et al. |
| 6,854,374 | B1 | 2/2005 | Breazeale |
| 6,901,839 | B2 | 6/2005 | Edberg et al. |
| 6,904,838 | B1 | 6/2005 | Dindl |
| 6,925,771 | B2 | 8/2005 | Lee et al. |
| 6,957,602 | B1 | 10/2005 | Koenig et al. |
| 7,177,518 | B2 | 2/2007 | Chun |
| 7,190,304 | B1 | 3/2007 | Carlson |
| 7,244,199 | B1 | 7/2007 | Romano |
| 7,308,738 | B2 | 12/2007 | Barvosa-Carter et al. |
| 7,318,258 | B2 | 1/2008 | Chun |
| 7,328,644 | B2 | 2/2008 | Vickroy |
| 7,412,916 | B2 | 8/2008 | Lloyd |
| 7,415,917 | B2 | 8/2008 | Lloyd |
| 7,513,186 | B2 | 4/2009 | Ravid et al. |
| 7,866,248 | B2 | 1/2011 | Moore et al. |
| 7,866,250 | B2 | 1/2011 | Farinella et al. |
| 8,011,285 | B2 | 9/2011 | Farinella et al. |
| 8,132,495 | B2 | 3/2012 | Joynt |
| 2001/0032577 | A1 | 10/2001 | Swartout et al. |
| 2001/0048102 | A1 | 12/2001 | Telles |
| 2002/0134365 | A1 | 9/2002 | Gray |
| 2003/0217502 | A1 | 11/2003 | Hansen |
| 2004/0016846 | A1 | 1/2004 | Blackwell-Thompson et al. |
| 2005/0011396 | A1 | 1/2005 | Burdette et al. |
| 2005/0016372 | A1 | 1/2005 | Kilvert |
| 2005/0278098 | A1 | 12/2005 | Breed |
| 2006/0065111 | A1 | 3/2006 | Henry |
| 2006/0112817 | A1 | 6/2006 | Lloyd |
| 2007/0057495 | A1 | 3/2007 | Tesch et al. |
| 2007/0089597 | A1 | 4/2007 | Ma |
| 2007/0180983 | A1 | 8/2007 | Farinella et al. |
| 2008/0164379 | A1 | 7/2008 | Wartmann et al. |
| 2008/0258063 | A1 | 10/2008 | Rapanotti |
| 2009/0084284 | A1 | 4/2009 | Martinez et al. |
| 2009/0104422 | A1 | 4/2009 | Sampson |
| 2009/0173250 | A1 | 7/2009 | Marscher et al. |
| 2009/0178597 | A1 | 7/2009 | Sliwa, Jr. |
| 2009/0217811 | A1 | 9/2009 | Leeming |
| 2009/0266226 | A1 | 10/2009 | Beach et al. |
| 2009/0266227 | A1 | 10/2009 | Farinella et al. |
| 2009/0308238 | A1 | 12/2009 | Schwartz |
| 2010/0282935 | A1 | 11/2010 | Zannoni |
| 2010/0288114 | A1 | 11/2010 | Soukos |
| 2010/0294124 | A1 | 11/2010 | Wentzel |
| 2010/0307328 | A1 | 12/2010 | Hoadley et al. |
| 2011/0067561 | A1 | 3/2011 | Joynt |
| 2011/0079135 | A1 | 4/2011 | Farinella et al. |
| 2011/0136087 | A1 | 6/2011 | Corridon |
| 2011/0179944 | A1 | 7/2011 | Farinella et al. |
| 2011/0185614 | A1 | 8/2011 | Laney et al. |
| 2011/0192014 | A1 | 8/2011 | Holmes, Jr. et al. |
| 2011/0203453 | A1 | 8/2011 | Farinella et al. |
| 2011/0252955 | A1 | 10/2011 | Radstake et al. |
| 2012/0011993 | A1 | 1/2012 | Malone et al. |
| 2012/0011994 | A1 | 1/2012 | Farinella et al. |
| 2012/0046916 | A1 | 2/2012 | Farinella et al. |

FOREIGN PATENT DOCUMENTS

| | | |
|---|---|---|
| DE | 24 09 876 | 9/1975 |
| DE | 25 07 351 | 9/1976 |
| DE | 3722420 | 1/1989 |
| DE | 3735426 | 5/1989 |
| DE | 3834367 | 4/1990 |
| DE | 4437412 | 9/1995 |
| EP | 0655603 | 5/1995 |
| EP | 0872705 | 10/1998 |
| EP | 0902250 | 3/1999 |
| FR | 2695467 | 3/1994 |
| GB | 2449055 | 11/2008 |
| WO | WO 99/30966 | 6/1999 |
| WO | WO 2006/134407 | 12/2006 |
| WO | WO 2006/135432 | 12/2006 |
| WO | WO 2008/079001 | 7/2008 |
| WO | WO 2008/070001 | 12/2008 |

OTHER PUBLICATIONS

Written Opinion of the International Searching Authority mailed Jan. 7, 2010 for International Application No. PCT/US2009/002363, 5 pages, unnumbered.

Written Opinion of the International Searching Authority mailed, dated Dec. 23, 2011 for International Application No. PCT/US2011/01462, 6 pages, unnumbered.

Written Opinion of the International Searching Authority mailed Jan. 31, 2013 for International Application No. PCT/US2012/063207 (six (6) pages total).

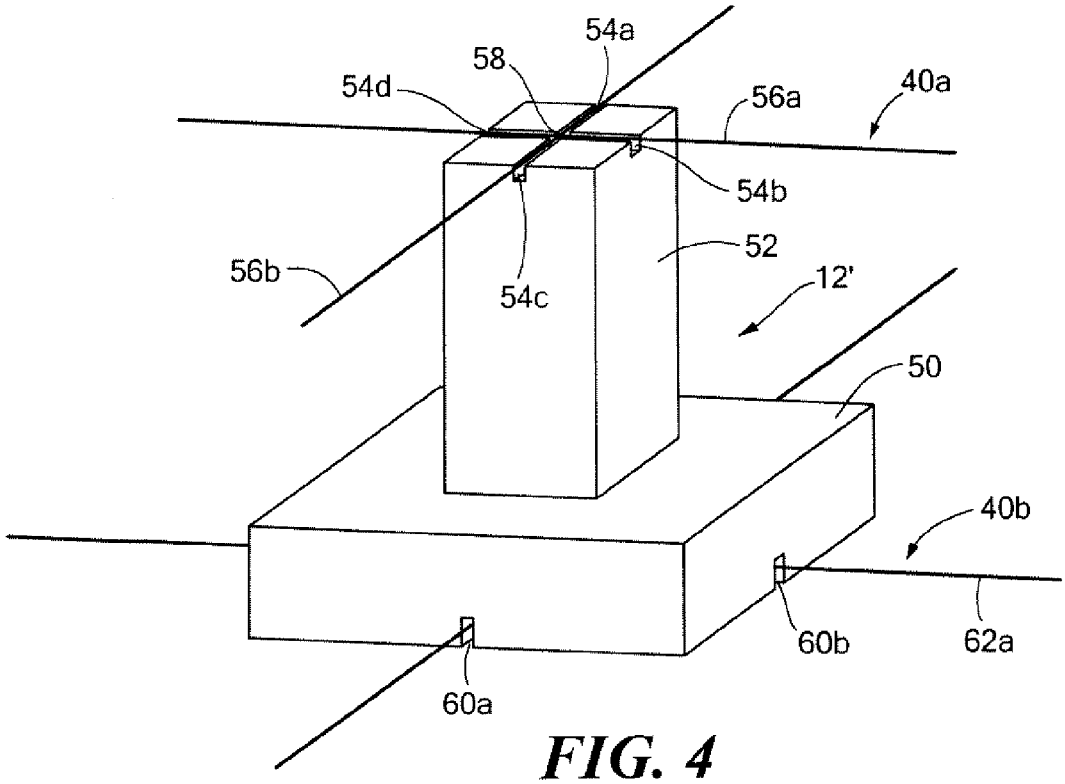
FIG. 4
FIG. 5
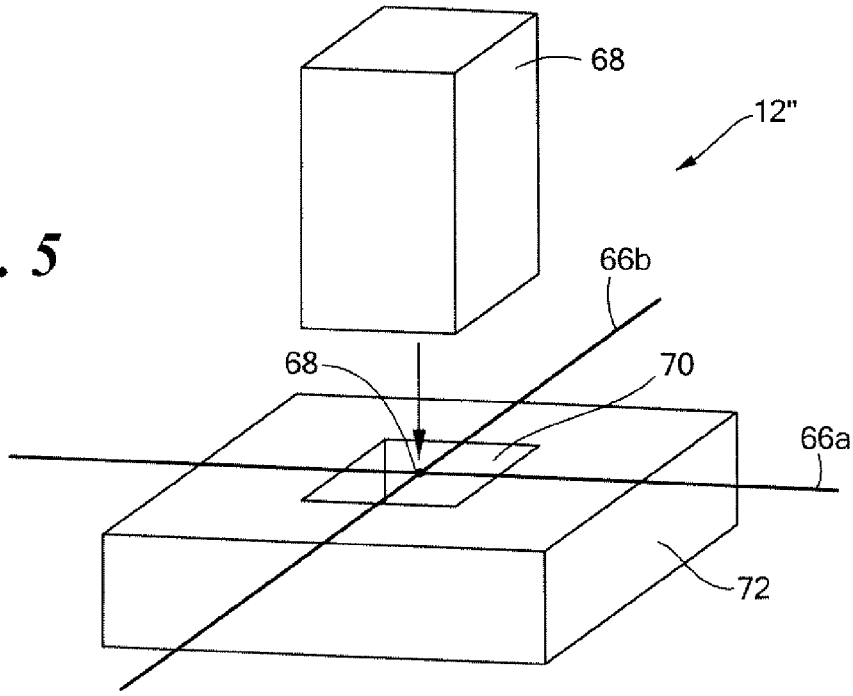

VEHICLE AND STRUCTURE SHIELD WITH FLEXIBLE FRAME

RELATED APPLICATIONS

This application is a continuation-in-part of U.S. patent application Ser. No. 13/373,408 filed on Nov. 14, 2011 and claims the benefit of and priority thereto under 35 U.S.C. §§119, 120, 363, 365, and 37 C.F.R. §1.55 and §1.78, which is a continuation-in-part of U.S. patent application Ser. No. 13/065,790 filed Mar. 30, 2011 which is a continuation-in-part of U.S. patent application Ser. No. 12/807,532 filed Sep. 8, 2010, which claims the benefit of and priority to U.S. patent application Ser. No. 12/386,114 filed Apr. 14, 2009, which claims the benefit of and priority to U.S. Provisional Application Ser. No. 61/124,428 filed Apr. 16, 2008. All said priority references are incorporated herein by this reference.

FIELD OF THE INVENTION

The subject invention relates to ordnance shielding.

BACKGROUND OF THE INVENTION

Rocket propelled grenades (RPGs) and other ordnance are used by terrorist groups to target military vehicles and structures. See WO 2006/134407 incorporated herein by this reference.

Others skilled in the art have designed intercept vehicles which deploy a net or a structure in the path of an RPG in an attempt to change its trajectory. See U.S. Pat. Nos. 7,190,304; 6.957,602; 5,578,784; and 7,328,644 all incorporated herein by this reference. Related prior art discloses the idea of deploying an airbag (U.S. Pat. No. 6,029,558) or a barrier (U.S. Pat. No. 6,279,499) in the trajectory path of a munition to deflect it. These references are also included herein by this reference.

Many such systems require detection of the RPG and deployment of the intercept vehicle quickly and correctly into the trajectory path of the RPG.

Static armor such as shown in U.S. Pat. Nos. 5,170,690; 5,191,166; 5,333,532; 4,928,575; and WO 2006/134,407 is often heavy and time consuming to install. When a significant amount of weight is added to a HMMWV, for example, it can become difficult to maneuver and top heavy. Such an armor equipped vehicle also burns an excessive amount of fuel.

Moreover, known static systems do not prevent detonation of the RPG. One exception is the steel grille armor of WO 2006/134,407 which is said to destroy and interrupt the electrical energy produced by the piezoelectric crystal in the firing head of the RPG. Bar/slat armor is also designed to dud an RPG. But, bar/slat armor is also very heavy. Often, a vehicle designed to be carried by a specific class of aircraft cannot be carried when outfitted with bar/slat armor. Also, if the bar/slat armor is hit with a strike, the RPG still detonates. Bar/slat armor, if damaged, can block doors, windows, and access hatches of a vehicle.

Chain link fence type shields have also been added to vehicles. The chain link fencing, however, is not sufficiently compliant to prevent detonation of an RPG if it strikes the fencing material. Chain like fencing, although lighter than bar/slat armor, is still fairly heavy. Neither bar/slat armor nor the chain link fence type shield is easy to install and remove.

Despite the technology described in the above prior art, Rocket Propelled Grenades (RPGs) and other threats used by enemy forces and insurgents remain a serious threat to troops on the battlefield, on city streets, and on country roads. RPG weapons are relatively inexpensive and widely available throughout the world. There are varieties of RPG warhead types, but the most prolific are the PG-7 and PG-7M which employ a focus blast or shaped charge warhead capable of penetrating considerable armor even if the warhead is detonated at standoffs up to 10 meters from a vehicle. A perfect hit with a shaped charge can penetrate a 12 inch thick steel plate. RPGs pose a persistent deadly threat to moving ground vehicles and stationary structures such as security check points.

Heavily armored, lightly armored, and unarmored vehicles have been proven vulnerable to the RPG shaped charge. Pick-up trucks, HMMWV's, 2½ ton trucks, 5 ton trucks, light armor vehicles, and M118 armored personnel carriers are frequently defeated by a single RPG shot. Even heavily armored vehicles such as the M1 Abrams Tank have been felled by a single RPG shot. The PG-7 and PG-7M are the most prolific class of warheads, accounting for a reported 90% of the engagements. RPG-18s, RPG-69s, and RPG-7Ls have been reported as well, accounting for a significant remainder of the threat encounters. Close engagements 30 meters away occur in less than 0.25 seconds and an impact speed ranging from 120-180 m/s. Engagements at 100 meters will reach a target in approximately 1.0 second and at impact speeds approaching 300 m/s.

The RPG-7 is in general use in Africa, Asia, and the Middle East and weapon caches are found in random locations making them available to the inexperienced insurgent. Today, the RPG threat in Iraq is present at every turn and caches have been found under bridges, in pickup trucks, buried by the road sides, and even in churches.

Armor plating on a vehicle does not always protect the occupants in the case of an RPG impact and no known countermeasure has proven effective. Systems designed to intercept and destroy an incoming threat are ineffective and/or expensive, complex, and unreliable.

Chain link fencing has been used in an attempt to dud RPGs by destroying the RPG nose cone. See, for example, DE 691,067. See also published U.S. Patent Application No. 2008/0164379. Others have proposed using netting to strangulate the RPG nose cone. See published U.S. Application No. 2009/0217811 and WO 2006/135432.

WO 2006/134407, insofar as it can be understood, discloses a protective grid with tooth shaped members. U.S. Pat. No. 6,311,605 discloses disruptive bodies secured to armor. The disruptive bodies are designed to penetrate into an interior region of a shaped charge to disrupt the formation of the jet. The shaped charge disclosed has a fuse/detonator mechanism in its tail end. See also Published Patent Application No. 2010/0288114 incorporation herein by this reference.

SUMMARY OF THE INVENTION

No known prior art, however, discloses a net supporting a spaced array of hard points at a set off distance from a vehicle or a structure wherein the hard points are designed to dig into the nose cone of an RPG and dud it.

Pending U.S. patent application Ser. Nos. 12/386,114; 12/807,558; 12/807,532 and 13/068,790 incorporated herein by this reference, disclose novel vehicle protection systems. The following reflects an enhancement to such a system.

In accordance with one aspect of the subject invention, a new vehicle and structure shield is provided which, in one specific version, is inexpensive, lightweight, easy to install and remove (even in the field), easy to adapt to a variety of platforms, effective, and exhibits a low vehicle signature. Various other embodiments are within the scope of the subject invention.

The subject invention results from the realization, in part, that a new vehicle and structure shield, in one specific example, features a plurality of spaced rods or hard points held in position via the nodes of a net and used to dud an RPG or other threat allowing the frame for the net to be lightweight and inexpensive and also easily attached to and removed from a vehicle or structure.

Featured is a protection system comprising an RPG protection subsystem, for example, a net with lines connected at nodes and hard points attached to at least select nodes. A frame supports the net and positions it in a spaced relationship with respect to a vehicle or structure. The frame includes tubular members wherein select adjacent tubular members are connected via a flexure to prevent damage to the frame when impacted.

In one example, adjacent tubular members are hollow and the flexure is a rubber rod inserted into the hollow tubular member. The rod can be fastened to each hollow tube member. Adjacent tubular members can be oriented in the same direction and then flexure is straight. Or, adjacent tubular members can be at an angle to each other and then the flexure is angled.

Preferably, the net includes low breaking strength intersecting lines. One hard point design includes a multi-sided body with a cavity therein behind the front face thereof and a plug received in the cavity locking a net node in the cavity and securing the hard point to the net in a pivotable fashion. In some examples, the net has a mesh between 110 and 190 mm, the hard point body has eight sides, four of which include slots receiving net lines therein. The plug can be tapered. The hard point body may include a lip extending into the cavity locking the plug therein and then the plug includes a ledge engaged by the lip. One preferred hard point has a length to diameter ratio of approximately 1.

It is also preferred that the net lines have a breaking strength (e.g., between 100 lb and 1,500 lbs) such that a line will break upon impact of an ordinance fuse with the line for a predetermined percentage of ordinance fuse impacts (e.g., 100% or 80%-100%). In some examples, the hard point weighs between 10 and 80 grams and the net line has a diameter of between 1.7 and 1.9 mm.

Also featured is a protection system comprising a flexible subsystem including spaced hard points and a frame supporting the flexible subsystem and positioning it in a spaced relationship with respect to a vehicle or structure. The frame includes tubular members, and select adjacent tubular members connected via a flexure to prevent damage to the frame when impacted. In one example, the flexible subsystem includes a net with lines defining nodes for the hard points.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which:

FIG. 4 is a schematic three-dimensional front view showing one example of a hard point rod attached to adjacent nodes of two spaced nets in accordance with the subject invention;

FIG. 5 is a schematic three-dimensional exploded view showing another example of a hard point rod in accordance with the subject invention;

DETAILED DESCRIPTION OF THE INVENTION

Figure 1:
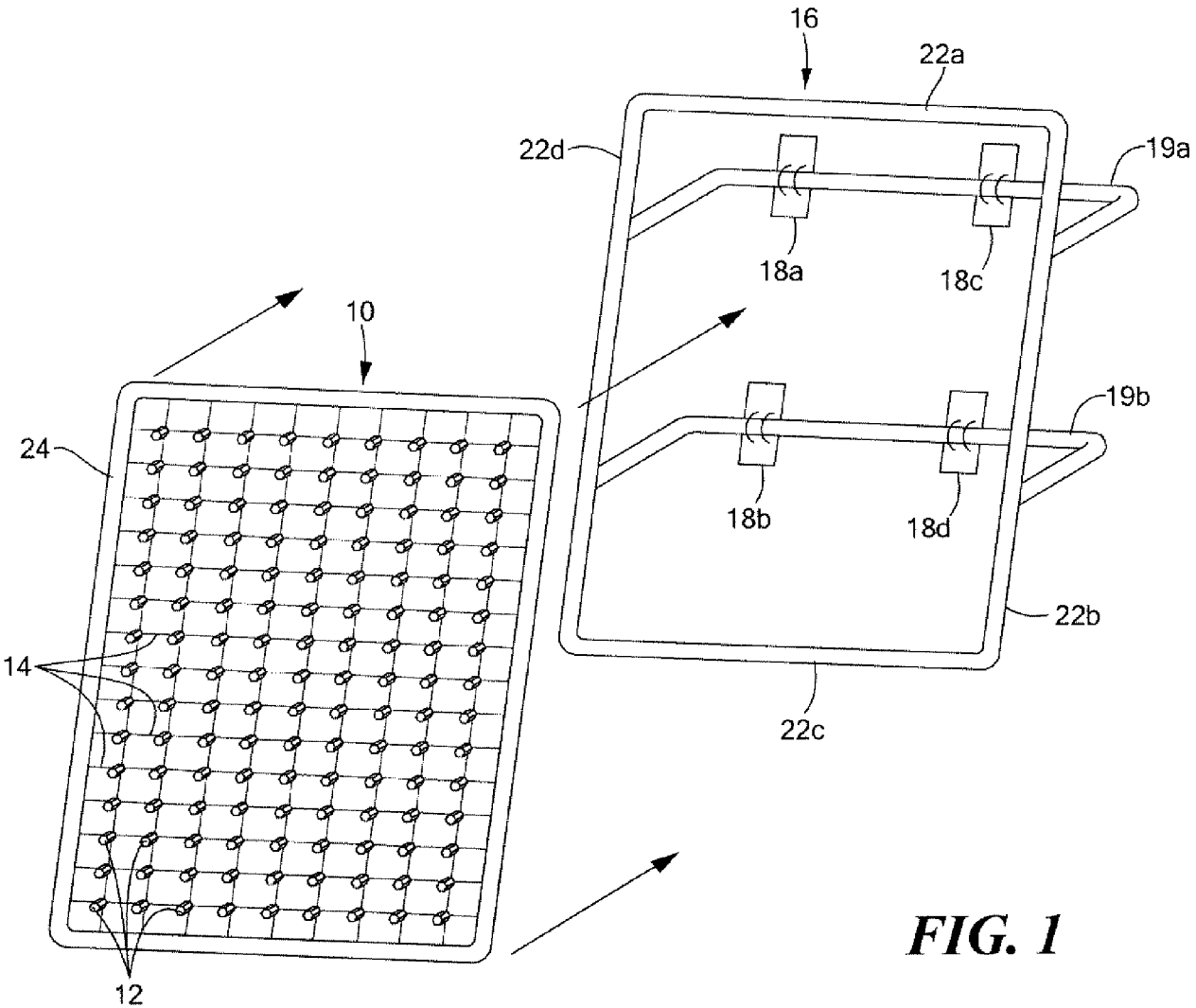
FIG. 1 is a highly schematic three-dimensional exploded view showing an example of one shield protection system in accordance with the subject invention.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows an example of flexible structures, e.g., net subsystem 10 and including an array of rods or hard points 12 configured to impact a projectile (e.g., the nose of an RPG) striking net 14. Frame 16 includes mounting brackets 18*a*-18*d* attached to rearwardly extending members 19*a* and 19*b*. The function of frame 16 and net 14 is to position rods 12 in a spaced relationship with respect to a vehicle or structure and to space the rods 12 apart from each other in an array. When an RPG impacts net 14, rods 12 may angle inwardly towards the nose of the RPG tearing into it and duding the electronics and/or electrical or electronic signals associated with the arming or detonation mechanisms of the RPG. By flexible, we generally mean a net which does not retain its shape unless supported in some fashion. When not attached to frame 16, net 14 can be rolled and then folded and/or net 14 can be bunched up.

Figure 2:
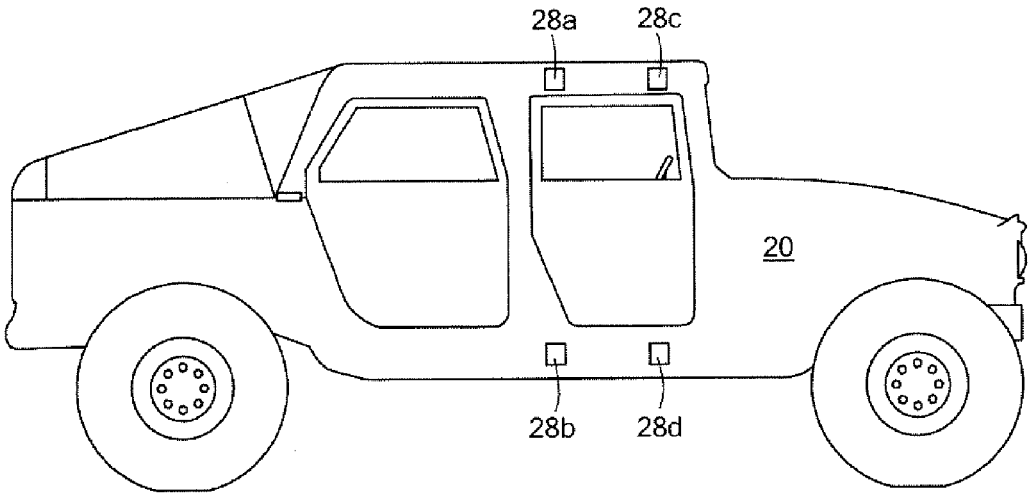
FIG. 2 is a schematic side view of a HMMWV vehicle equipped with hook and loop patches for installation of the shield system shown in FIG. 1.

Preferably, net subsystem 10 is removeably secured to frame 16 and frame 16 is removeably secured to vehicle 20, FIG. 2 (e.g., a HMMWV vehicle). In one particular example, frame members 22*a*-22*d* include hook type fasteners secured to the outside thereof and the net periphery includes loop type fasteners on the inside thereof. Loop type fasteners are also secured to the rear of frame 16 mounting brackets 18*a*-18*d* and corresponding pads or patches 28*a*-28*d*, FIG. 2, adhered to vehicle 20, include outer faces with hook type fasteners. The hook and loop fastening mechanisms, however, may be reversed and other flexible fastener subsystems may also be used. The hook and loop fastening subsystems of U.S. Pat. Nos. 4,928,575; 5,170,690; 5,191,166; and 5,333,532 are preferred.

Figure 3:
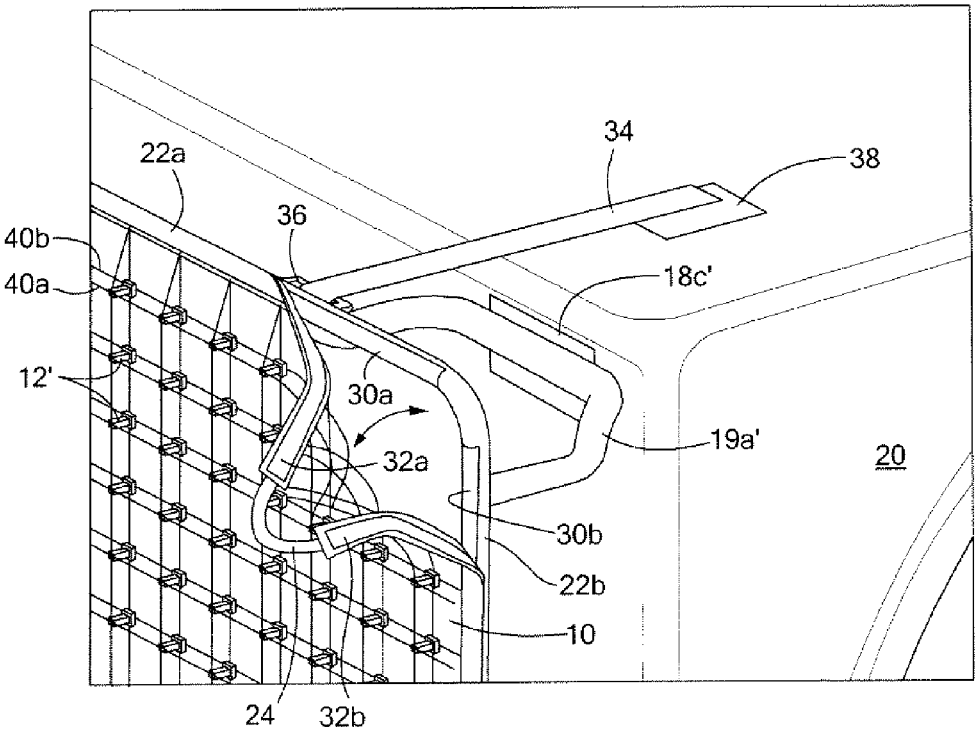
FIG. 3 is a schematic partial side view showing a shield subsystem in accordance with an example of the subject invention now installed on a portion of a vehicle.

FIG. 3 shows frame members 22*a* and 22*b* including hook type fastener strips 30*a* and 30*b*, respectively, and net periphery fabric border 24 including loop type fastener strips 32*a* and 32*b*. Mounting bracket 18*c*' is attached to rearwardly extending frame member 19*a*' and includes a rearward face with loop type fasteners. FIG. 3 also shows optional strap 34 extending from ear 36 on frame member 22*a* to attachment 38 on vehicle 20 which may also be secured to vehicle 20 using hook and loop fasteners. Additional straps may also be included. FIG. 3 also shows first (outer) net 40*a* and second (inner) net 40*b* with their nodes interconnected via rods 12'.

As shown in FIG. 4, rod 12' includes base portion 50 and post portion 52 extending from base portion 50. Post 52 includes castellations 54*a*-54*d* for the line lines 56*a* and 56*b* of net 40*a* defining node 58. Similarly, base 50 includes castellations (e.g, castellations 60*a* and 60*b*) for lines 62*a* and 62*b* of net 40*b* also defining a node (not shown). The lines of the nets may be glued or otherwise secured in the castellations.

FIG. 5 shows a single net design where net lines or strings 66*a* and 66*b* defining node 68 are secured between post portions 68 frictionally received in cavity 70 of base portion 72 of rod 12". The preferred rod is made of steel, has a one inch post, and weighs between 15 and 30 grams.

Figure 6A:
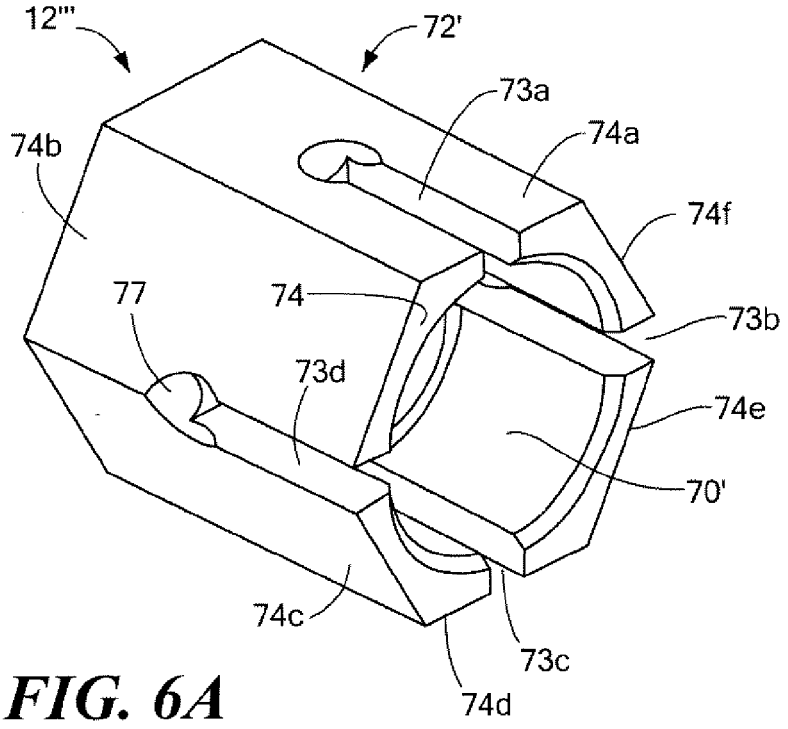
FIGS. 6A-6D are schematic views of other hard point designs in accordance with examples of the subject invention.
Figure 6B:
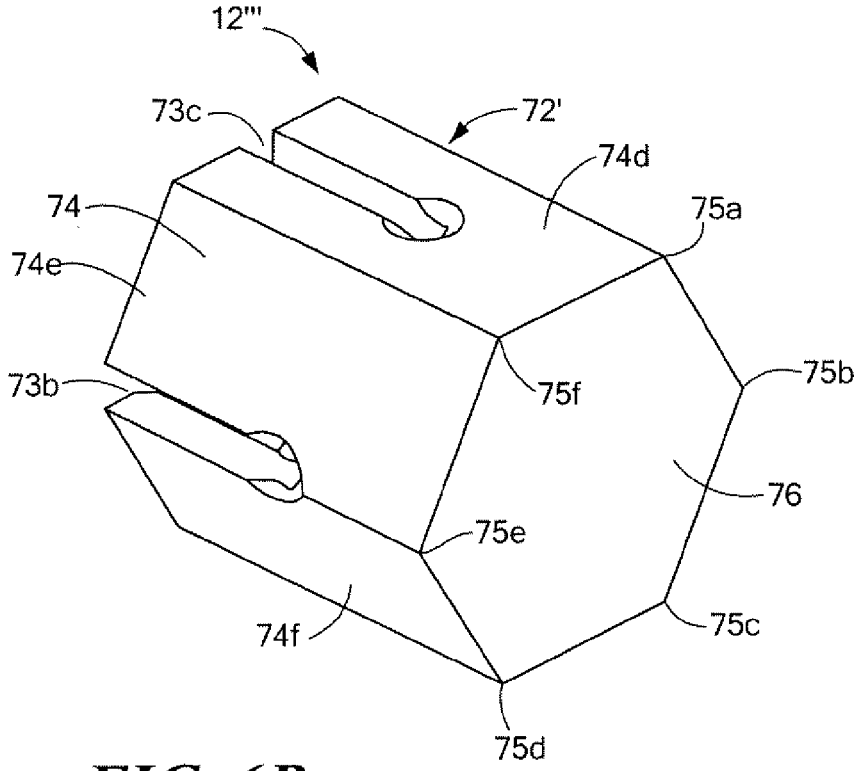
Figure 7A:
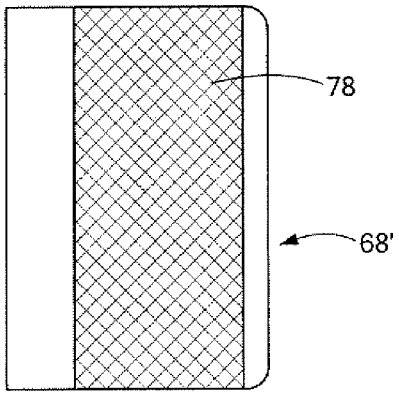
FIG. 7A-7B are schematic views of a plug for the hard point shown in FIGS. 6A-6D.
Figure 7B:
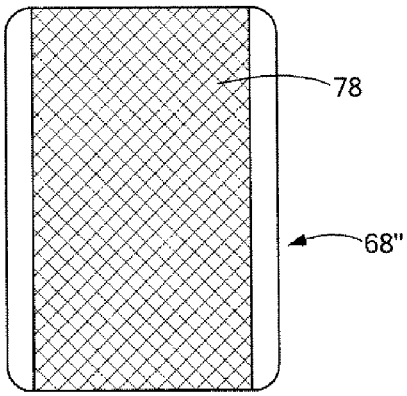

FIGS. 6A-6B shows hard point 12'" with forward facing base portion 72' with cavity 70' receiving post or plug 68', FIG. 7 therein in a friction fit manner. This hard point is designed for nets including intersecting lines connected at nodes. See FIGS. 1 and 5. In this preferred design, a connected net node is received in cavity 70' while the net strings are received through slots 73*a*-*d* in wall 74 of hard point 72'. In this way, the hard points pivot at the net nodes. The slots, as shown for slot 73*a*, terminate in rounded portion 77 preventing wear of the net lines. Wall 74 in this embodiment defines a six-sided structure with six sharp corners 75*a*-75*f* which dig into the skin of an RPG ogive. Top surface 76 may be flat as shown or concave. Slots 73*a* and 73*c* receive vertically extending line 66*b*, FIG. 5 while slots 73*d* and 73*b*, FIG. 6A receive horizontally extending line 66*a*, FIG. 5. In one specific design, the hard point and the plug were made of steel, hard point 72' was 0.625 inches from one edge to an opposite edge, and 0.72 inches tall. Cavity 70' was 0.499 inches in diameter and 0.34 inches deep. Five gram cylindrical plug 68', FIGS. 7A-7B was 0.35 inches tall, 0.500 inches in diameter, and includes knurling as shown at 78 on the outer wall surface thereof.

Side walls 74*a*-74*f* extend rearward from front face 76 defining cavity 70' surrounded by the side walls. Opposing sidewalls 74*a* and 74*d* have slots (73*a*, 73*c*) in the middle of each side wall. Slots 73*d*, and 73*b*, in turn, are between adjacent sidewalls 74*b* and 74*c* and 74*f* and 74*e*, respectively. Sidewall 74*b* and 74*c* are between opposing sidewalls 74*a* and 74*b* on one side of member 72' while sidewall 74*f* and 74*e* are between opposing sidewalls 74*a* and 74*d* on the opposite side of member 72'.

In this specific design, the base portion 72' and plug 68' (FIG. 7) were made of hardened steel (e.g., ASTM A108 alloy 12L14) and combined weighed between 10 and 80 grams. A base portion with more or less sides is also possible. For a six sided design, the area of face 76, FIG. 613, is typically about 0.5 in.$^2$, e.g. between 0.1 and 0.8 in.$^2$. Sidewalls 74*a*-*f* typically have an area of 0.37 in.$^2$, e.g., between 0.1 and 0.8 in.$^2$. Slots 73*a*-*d* may be 0.05-0.15 inches wide and between 0.2 and 0.8 inches long.

Figure 6C:
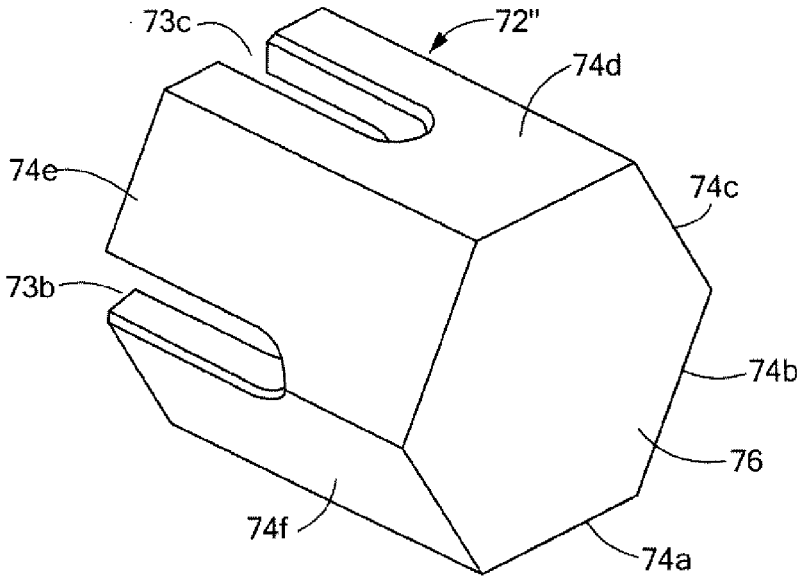
Figure 6D:
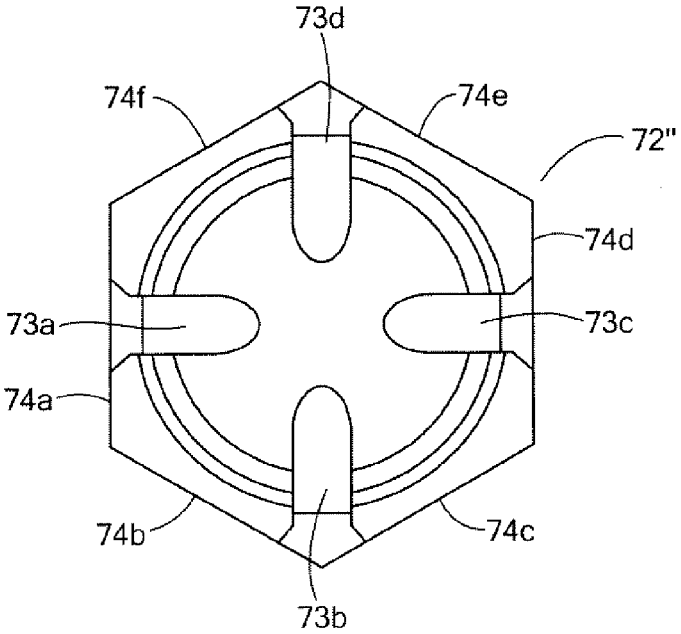

Manufacturing of a net with hard points in accordance with the subject invention is thus simplified. A net node is placed in cavity 70', FIG. 6A with the net strings exciting through slots 73*a*-73*d* and plug 68', FIG. 7A is then driven in to cavity 70', FIG. 6A to lock the node of the net in the hard point. The hard points are typically made of conductive material and may include a protective rust resistant non-reflective, conductive coating (zinc plating, flat olive in color). Geomet Coatings (NOF Metal Coatings NA, Chardon, Ohio) may be used. In one example shown in FIGS. 6C-6D, base portion 72" weighed 30 grams and was machined from 0.625 hex bar stock. Walls 74*a*-74*f* were 0.72" tall. Slots 73*a*-73*d* were 0.080 inches across and 0.350" in length. These dimensions will vary, however, depending on the design of the net.

There are trade offs in the design of the hard points and also the net. The aspect ratio of the hard points, their size, center of gravity, mass, and the like all play an important role. Hard points which are too large, for example, and a net mesh size which is too small, results in too much surface area to be stricken by an RPG, possibly detonating the RPG. Hard points which are too small may not sufficiently damage the RPG ogive and dud the RPG. Steel is a good material choice for the hard points because steel is less expensive. Tungsten, on the other hand, may be used because it is heavier and denser, but tungsten is more expensive. Other materials are possible. The hard points may be 0.5 inch to 0.75 inches across and between 0.5 inches and 1 inch tall.

It is preferred that the net node is placed at the center of gravity at the hard point. The length of the hard point is preferably chosen so that when an RPG strikes the net, the pivotable hard point tumbles 90 degrees or so and digs into the RPG ogive. The moment of inertia of the hard point is designed accordingly. In still other designs, the hard point may have more or less than six sides. The hard points may weigh between 10 to 80 grams although in testing 60 grams was found to be optimal, e.g., a 30 gram base portion and a 30 gram plug. Hard points between 10 and 40 grams are typical.

The net material may be polyester which provides resistance to stretching, ultraviolet radiation resistance, and durability in the field. Kevlar or other engineered materials can be used. A knotted, knotless, braided, or ultracross (knotless) net may be used. In this way, the intersecting lines of the net are connected at the net nodes. The net material diameter may be 1.7 to 1.9 mm. Larger net lines or multiple lines are possible, however, the design should be constrained to beneath threshold force to dynamic break loads typical of RPG impact and engagements. The typical net mesh size may be 176 mm (e.g., a square opening 88 mm by 88 mm) for a PG-7V RPG and 122 mm for a PG-7 VM model RPG. But, depending on the design, the net mesh size may range from between 110 and 190 mm.

The preferred spacing or standoff from the net to the vehicle is between 4 and 24 inches, (e.g., 6-12 inches) but may be between 4 and 60 centimeters. Larger standoffs may extend the footprint of the vehicle and thus be undesirable. Too close a spacing may not insure closing of the electrical circuitry of the RPG ogive by the hard points. The frame and mounting brackets are designed to result in the desired spacing.

It is desirable that the net material and mesh size be chosen and the net designed such that an RPG ogive, upon striking a net line, does not detonate. RPGs are designed to detonate at a certain impact force. Preferably, the breaking strength of the net line material is around 240 lbs so that an RPG, upon striking a string, does not detonate. Breaking strengths below about 1500 lbs are preferred. The net is thus designed to be compliant enough so that it does not cause detonation of the RPG. Instead, the hard points dig into the RPG ogive and dud the RPG before it strikes the vehicle or structure.

This design is in sharp contrast to a much more rigid chain link fence style shield which causes detonation of the RPG if the RPG strikes a wire of the fence. The overall result of the subject invention is a design with more available surface area where duding occurs as opposed to detonation.

Figure 8:
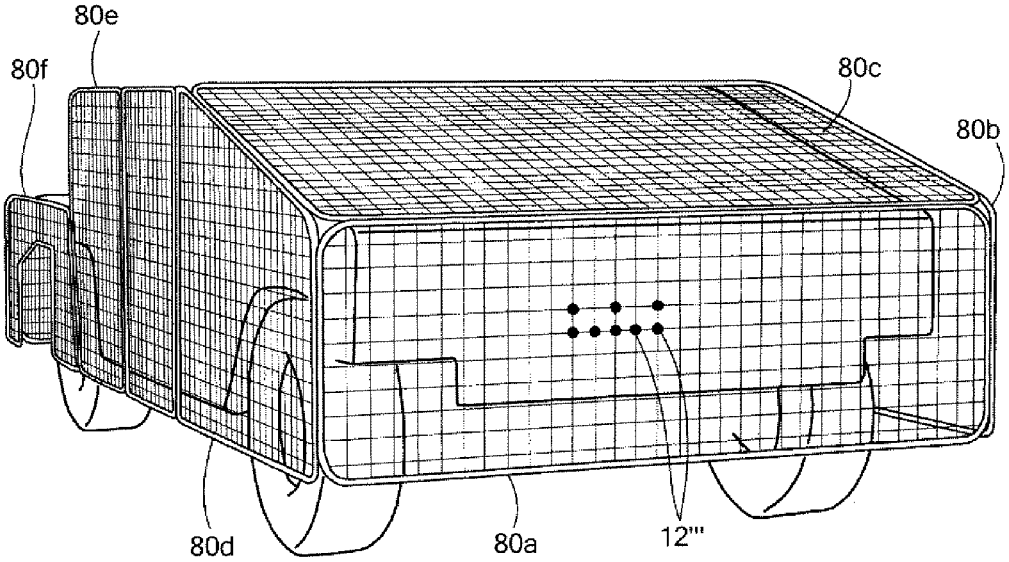
FIG. 8 is a schematic three-dimensional front view showing a number of net shields removeably attached to a military vehicle in accordance with the subject invention.
Figure 9:
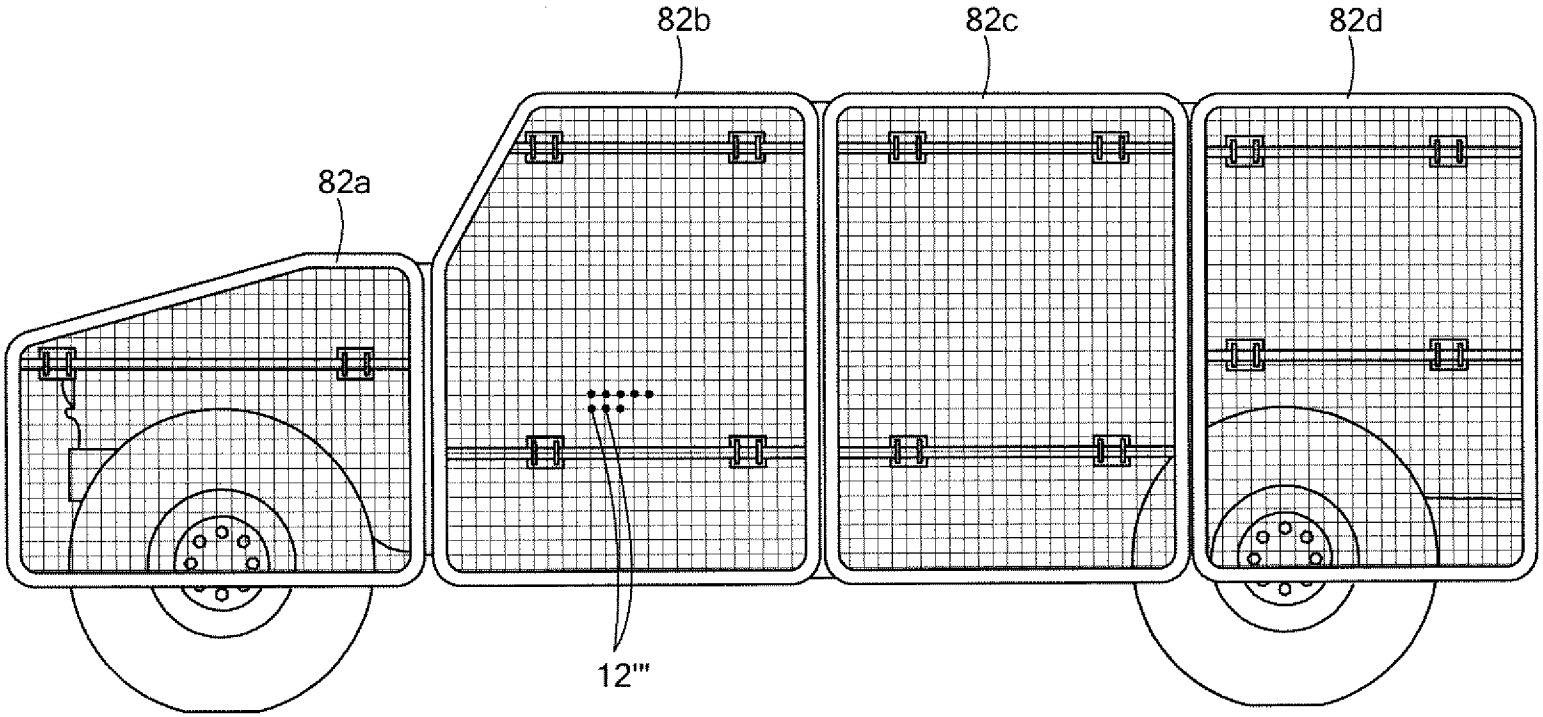
FIG. 9 is a schematic three-dimensional side view showing a number of net shields attached to the side of a military vehicle.
Figure 11:
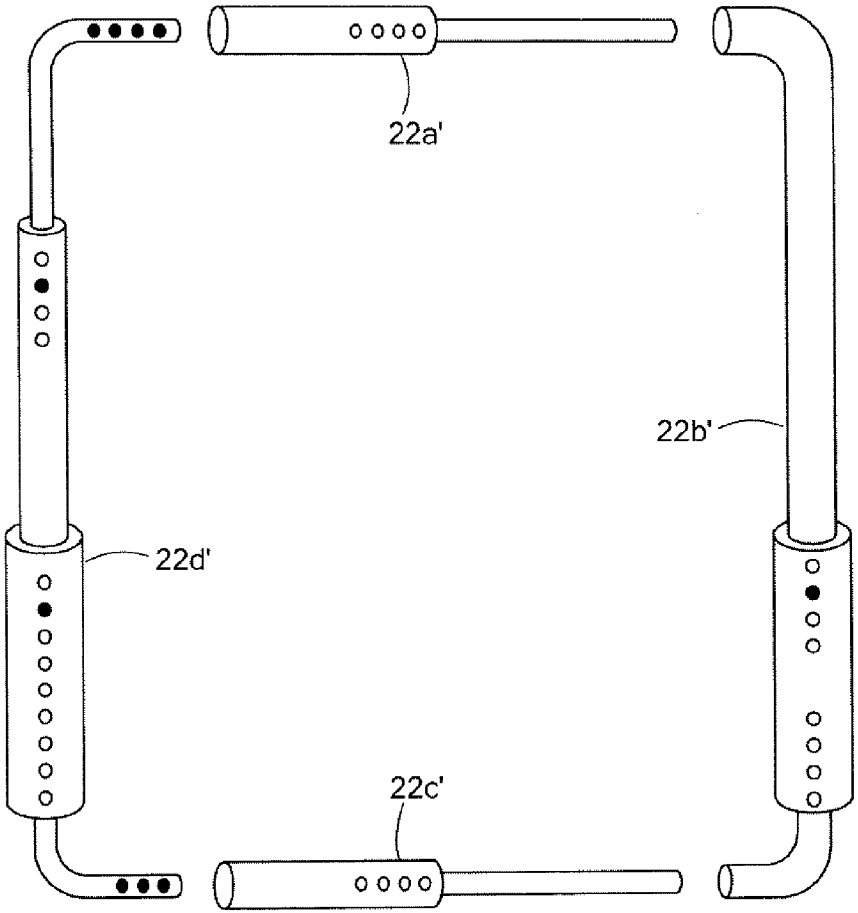
FIG. 11 is a schematic three-dimensional exploded front view showing telescoping frame members in accordance with the subject invention.

FIG. 8 shows shields 80*a*-80*f* and the like protecting all of the exposed surfaces of vehicle 20. FIG. 9 shows shields 82*a*-82*d* protecting the driver's side of vehicle 20. Only a few hard points 12''' are shown for clarity. Typically, there is a hard point at each node of the net.

Figure 10:
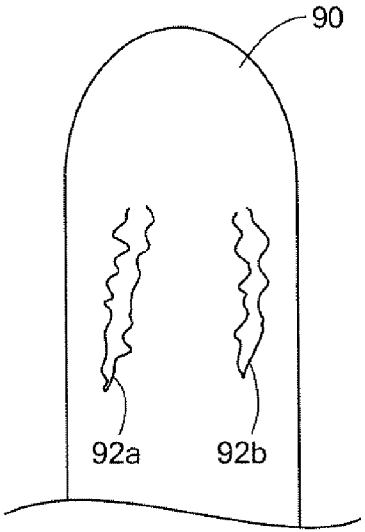
FIG. 10 is a highly schematic three-dimensional top view showing a RPG nose duded by the shield subsystem in accordance with the subject invention.

When an RPG nose or ogive 90, FIG. 10 strikes a shield, the rods or hard points pivotably disposed at the nodes of the net(s) angle inwardly toward nose 90 and tear into the skin thereof as shown at 92*a* and 92*b*. The hard points can bridge the inner and outer ogive serving as short to dud the RPG. Or, the hard points tear into the ogive and the torn material acts as a short duding the round. If the net and/or frame is destroyed, another shield is easily installed. The net thus serves to position the hard points in an array at a set off distance from the vehicle or structure to be protected. An effectiveness of 60-70% is possible. Chain link fencing exhibited an effectiveness of about 50%. Netting without hard points likely exhibited an effectiveness of less than 50%. Slat/bar armor reportedly had and effectiveness of around 50%.

FIG. 9 shows how frame members 22*a*' can comprise adjustable length telescoping sections for ease of assembly and for tailoring a particular frame to the vehicle or structured portion to be protected.

In one embodiment, the frame members are made of light weight aluminum. One complete shield with the net attached weighed 1.8 lbs. The shield is thus lightweight and easy to assemble, attach, and remove. If a given shield is damaged, it can be easily replaced in the field. The rods connected to the net cell nodes are configured to angle inwardly when an RPG strikes the net. This action defeats the RPG by duding it since the electronics associated with the explosives of the RPG are shorted as the rods impact or tear through the outer skin of the RPG ogive.

The result, in one preferred embodiment is an inexpensive and light weight shielding system which is easy to install and remove. The shields can be adapted to a variety of platforms and provide an effective way to prevent the occupants of the vehicle or the structure from injury or death resulting from RPGs or other ordnances. When used in connection with vehicles, the shield of the subject invention exhibits a low vehicle signature since it extends only a few inches from the vehicle.

The system of the subject invention is expected to meet or exceed the effectiveness of bar/slat armor and yet the flexible net style shield of the subject invention is much lighter, lower in cost, and easier to install and remove. The system of the subject invention is also expected to meet or exceed the effectiveness of chain link fence style shields and yet the net/hard point design of the subject invention is lower in cost, lighter and easier to install and remove.

Figure 12A:
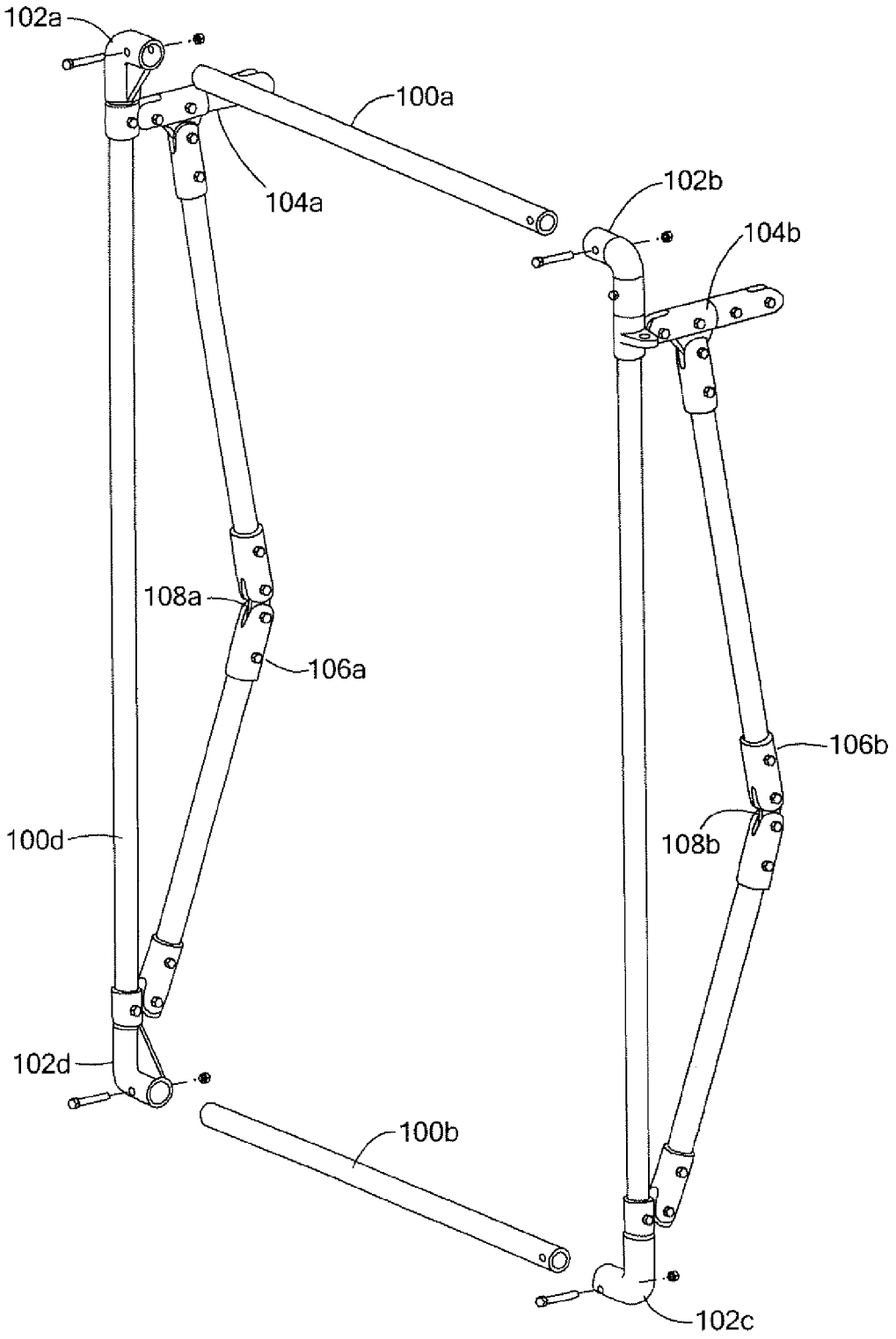
FIG. 12A is a front view of a frame structure in accordance with an example of the invention.
Figure 12B:
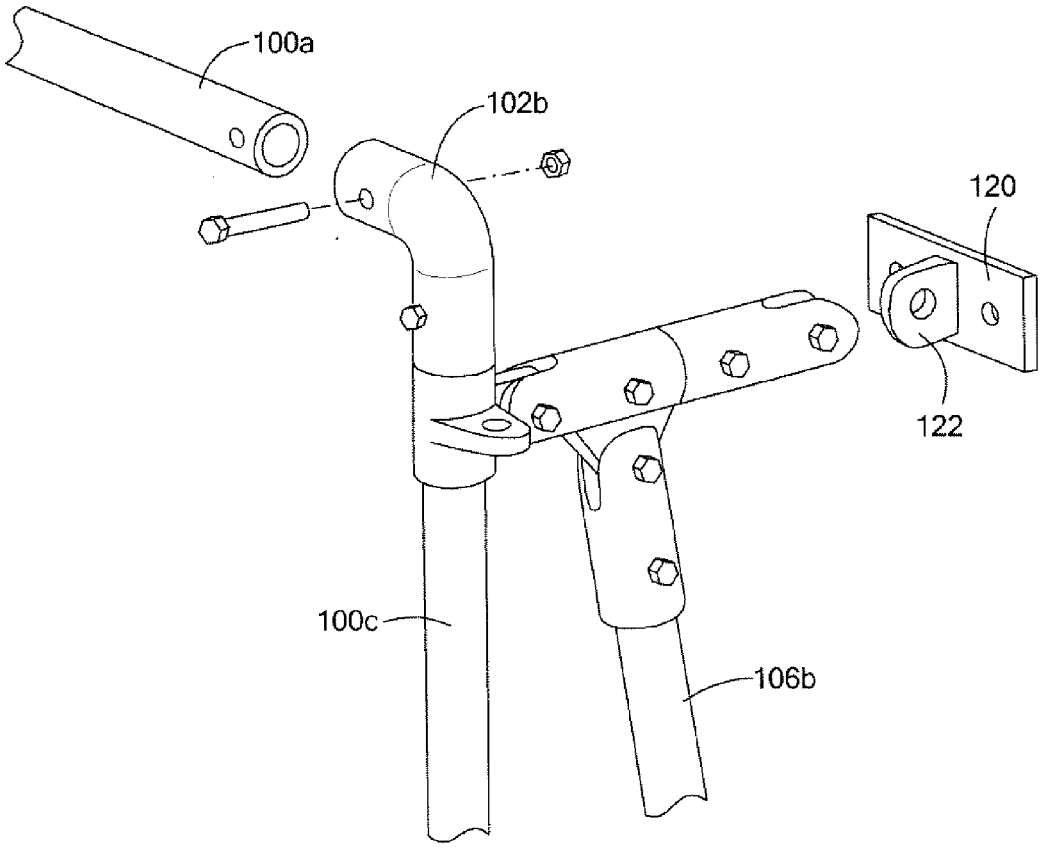
FIG. 12B is a view of one portion of the frame structure shown in FIG. 12A.

One design of a frame 16, FIGS. 12A-12B includes tubular upper frame member 100*a*, lower frame member 100*b*, and side frame members 100*c* and 100*d* all interconnected via corner members 102*a*-*d*. The result is a polygon with spaced sides and an upper and lower portion.

Figure 12C:
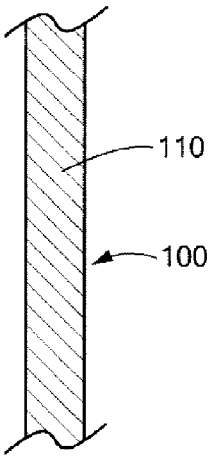
FIG. 12C is a front view of one frame member of the frame structure shown in FIG. 12A showing a spiral wrap of Velcro material thereabout.

Spaced rearwardly extending members 104*a* and 104*b* are attached to the upper portion of the members 100*d* and 100*c*, respectively, just below the corner members 102*a* and 102*b*. Rearwardly extending members 106*a* and 106*b* are on each side of the frame and each include a hinged joint 108*a* and 108*b*, respectively. Each of these members extends between a side member at the bottom of the frame and a rearwardly extending member at the top of the frame where they are hingely attached thereto. All of the hinged joints may be pin and clevis type joints as shown. As shown in FIG. 12C, each frame member 100*a*-100*d* includes a spiral wrap 110 of a hook type fastener material secured thereto to releasably receive the loop type fastener material (32*a*, 32*b*, FIG. 3) of the net fabric border. In this way, the net is easily attached and removed from the frame.

Typically, the frame is attached to the vehicle or structure using metal plates with an ear extending outwardly therefrom, such as plate 120, FIG. 12*b* with ear 122. In other instances, however, features already associated with the vehicle or structure to be protected can be used to secured the frame with respect to the vehicle or structure.

Figure 13:
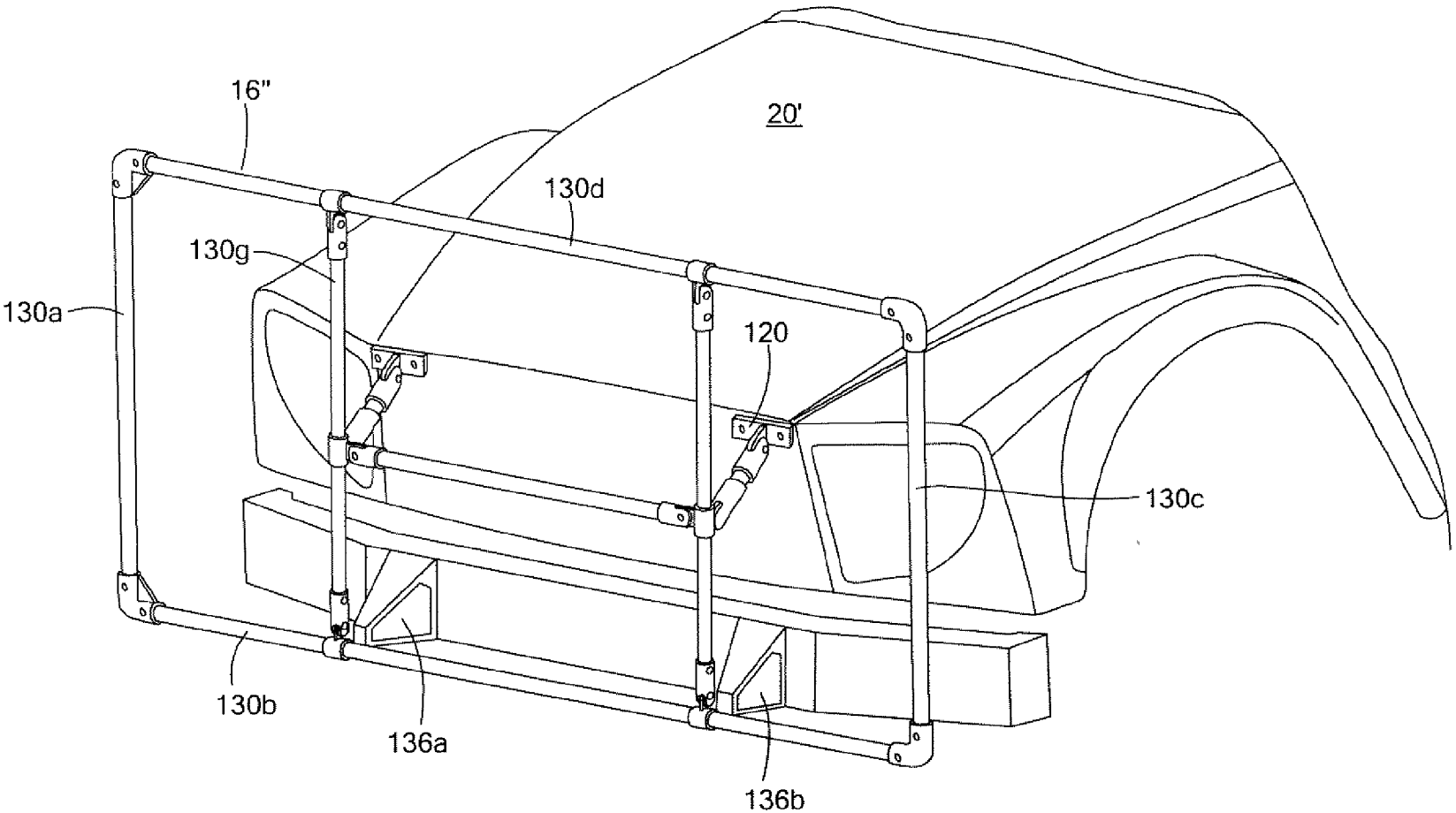
FIG. 13 is a partial schematic view showing a frame structure attached to the front of a vehicle in accordance with an example of the subject invention.

For example, FIG. 13 shows frame 16" attached to a vehicle. Frame 16" includes frame members 130*a*-130*g*, rearwardly extending member 132*a* and 132*b* hingely connected to plates 134*a* and 134*b*, respectively, bolted to the vehicle. Features 136*a* and 136*b* of vehicle 20' are connected to the joints between frame members 130*b*, 130*g* and 130*f*. Thus, the frame, the mounting brackets, and the like may vary in construction depending on the configuration of the vehicle or structure to be protected, the location on the vehicle to protected and the like. Typically, the frame members are tubular aluminum components and in one example they were 1-2 inches outer diameter, 0.75-1.75 inches inner diameter, and between 3 and 10 feet long.

Figure 14:
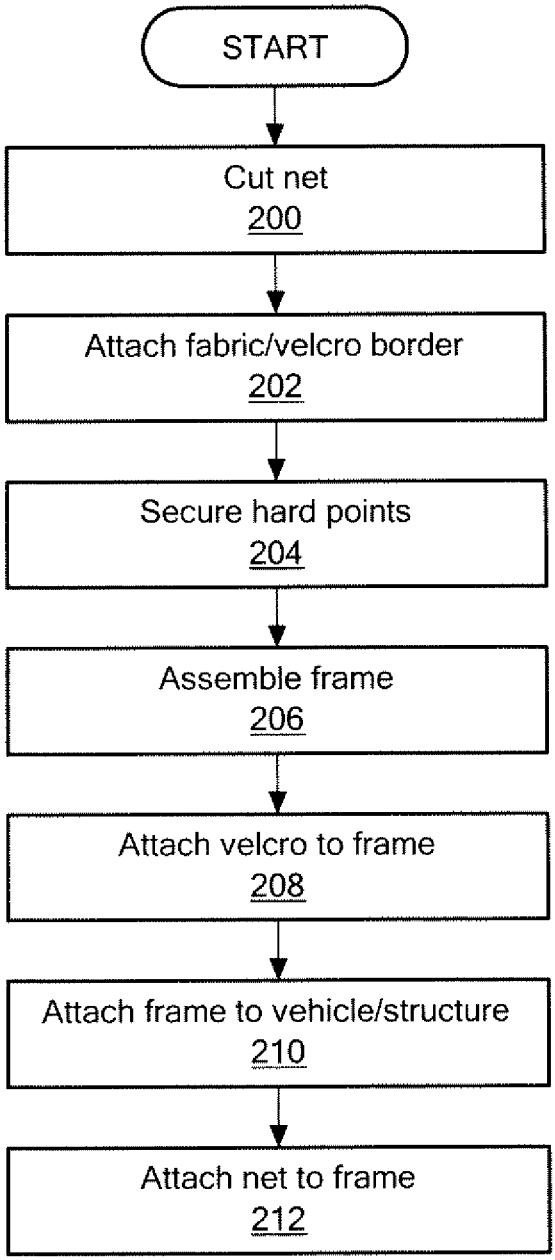
FIG. 14 is a flow chart depicting the primary steps associated with a method of protecting a vehicle or structure in one example of the invention.

Assembly of a vehicle or structure shield, in accordance with examples of the invention, typically begins with cutting the bulk netting, step 200, FIG. 14 into square or rectangular shapes. Next a fabric border is sewed to the net edges, step 202 and includes loop type fastener material on at least one side thereof.

The hard points are they secured to the net nodes, step 204. For example, the net may be laid on a table and hard point female members 72', FIG. 6A-6B are positioned under each node with the net lines extending through slot 73*a*-73*d*. Plugs 68'. FIG. 7, are then driven partly into each cavity of the female base portions using finger pressure and/or a hammer. Then, the plugs are seated in their respective cavities using a pneumatic driver.

The appropriate frame is then designed and assembled step 206, FIG. 14, and the hook fastener material is taped or glued to the frame members (see FIG. 12C), step 208. In the field, the frame is secured to the vehicle or structure, step 210, and the net is attached to the frame, step 212, using the loop type fastener material of the net periphery border and the hook fastener material on the frame members. Assembly of the frame to the vehicle or structure and releasably attaching the net to the frame is thus simple and can be accomplished quickly.

As noted above, it is desirable that the net material and mesh size be chosen in the net design such that an RPG ogive, upon striking a net line, does not detonate. RPGs are designed to detonate at a certain impact force. Preferably, the breaking strength of the net line material is designed such that an RPG, upon striking a net line or lines does not detonate.

Figure 15:
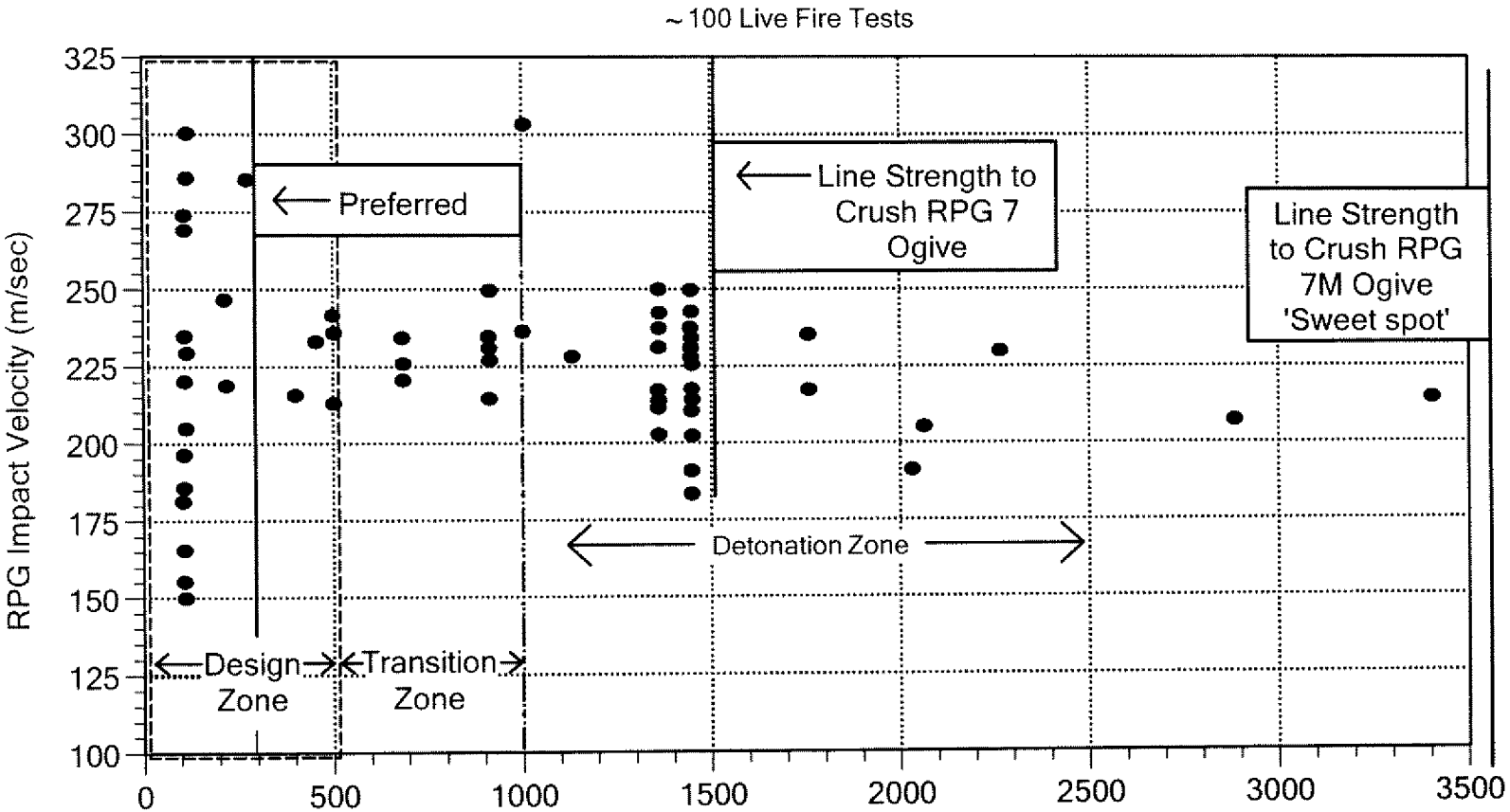
FIG. 15 is a graph showing line strength and impact velocity for a number of live fire tests.

FIG. 15 shows live fire RPG tests at nets with varying breaking strengths using a simulated RPG 7 test unit. Nets with lines having a breaking strength of below about 250 lbs resulted in no detonations of the RPGs when the RPG fuse struck a line between two nodes of the net. When the net material strength was about 1,000 lbs, in contrast, the RPG fuse was triggered approximately 10% of the time. A line strength above about 1,500 lbs, most RPG strikes resulted in detonation.

Thus, preferably, the net line strength for this particular RPG should be less than about 500 lbs resulting in approximately a 100% chance that the line will break upon impact of an RPG fuse with a net line. If higher net strength are desired for a particular application, then a net line strength of 1,000 lbs should not be exceeded in order to insure a chance of between 80% and 100% that an RPG fuse impact with a net line will not cause detonation of the RPG fuse.

Theoretically, a net line strength approaching 0 lbs is preferred to insure no RPGs will detonate when the nose fuse thereof strikes a net line. But, a net must support the hard points in an array in space and also must be sufficiently durable for various missions. So, an engineering tradeoff is made and it has been discovered that net line strengths of between about 200 lbs and 500 lbs results in a sufficiently durable net which does not cause detonation of an RPG when its nose fuse strikes a net line. Instead, the net line breaks. Surprisingly, even if this occurs, the hard points at the net interstices or nodes still dig into the RPG ogive and fairly reliably short the RPG fusing circuitry in a fairly effective manner. For other RPG models, the breaking strength of the net material may be a higher or low based on the fuse sensitivity and the desired percentage of strikes which will not cause detonation of an RPG.

Such a system and method of choosing net material is quite different than prior art net designs without hard points where the net material itself must be sufficiently strong to ensure the nose cone of an RPG is damaged or strangulated before the net strands fail. In the subject invention, in sharp contrast, the hard points function to disarm the RPG rather than the net material which is specifically designed to fail so it does not cause detonation of an RPG if its nose fuse strikes a net strand or line.

Accordingly, in one embodiment, a shield system for an RPG having a particular fuse sensitivity includes a frame, a flexible net subsystem supported by the frame wherein the flexible net subsystem includes lines of net material intersecting at nodes forming mesh openings and hard points attached to at least select nodes. The net material is designed to have a breaking strength such that a line will break upon impact of an RPG fuse with the line for a predetermined percentage of RPG fuse impacts. In the example of an RPG 7, a breaking strength of approximately 500 lbs or less results in an almost 100% chance that the line will break upon impact of an RPG fuse with the line. In one example, net material was chosen such that it had a breaking strength of about 250 lbs. In general, a breaking strength of between 100 lbs-500 lbs is preferred. Net material having a breaking strength of between 500 lbs and 1,000 lbs results in a line breaking upon impact of an RPG 7 fuse with the line for between about 80% and 100% of RPG fuse impacts. A method of fabricating an RPG shield system in accordance with the invention includes determining for an RPG (for example an RPG 7) which net material has a breaking strength such that a net line will break upon impact of an RPG fuse with the line for a predetermined percentage of RPG fuse impacts and then selecting the net material which has a breaking strength such that a line will break upon impact of an RPG fuse with the line for that predetermined percentage of RPG fuse impacts. Hard points are attached to selected net material nodes as discussed above and the net with the hard points attached thereto is attached to a frame as also discussed above.

Figure 16:
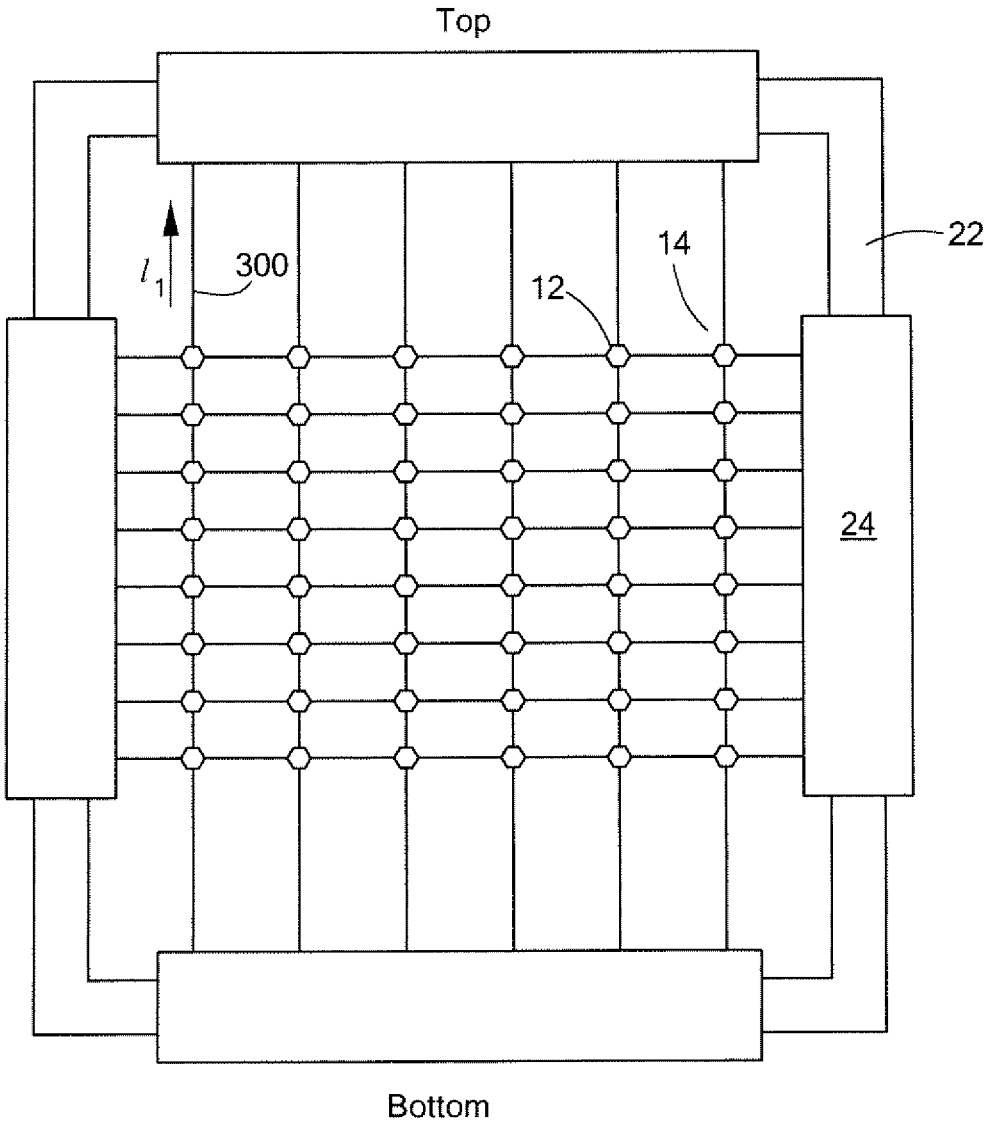
FIG. 16 is a front view showing another embodiment of an ordnance shield subsystem in accordance with the subject invention.

FIG. 16 shows a design with a net 14 carrying hard points 12 and bordered by fabric border 24 secured to frame 22 to be fixed to and spaced from a vehicle or structure to be protected in a vertical orientation as shown and as discussed above. Here, the net strands run vertically and horizontally resulting in square or rectangular openings and a load for example, on net strand 300 due to the hard point(s) it supports and the tension on net strand 300.

In the field, when the system is mounted on a vehicle, for example, hard points 12, jerk, bounce, oscillate and can wear rather weak strand 300 resulting in it breaking. Other strands can similarly break resulting in a less effective system. Increasing the breaking strength and/or size of the net strands may be undesirable because then an ordinance such as an RPG may detonate if it strikes a net strand.

Figure 17:
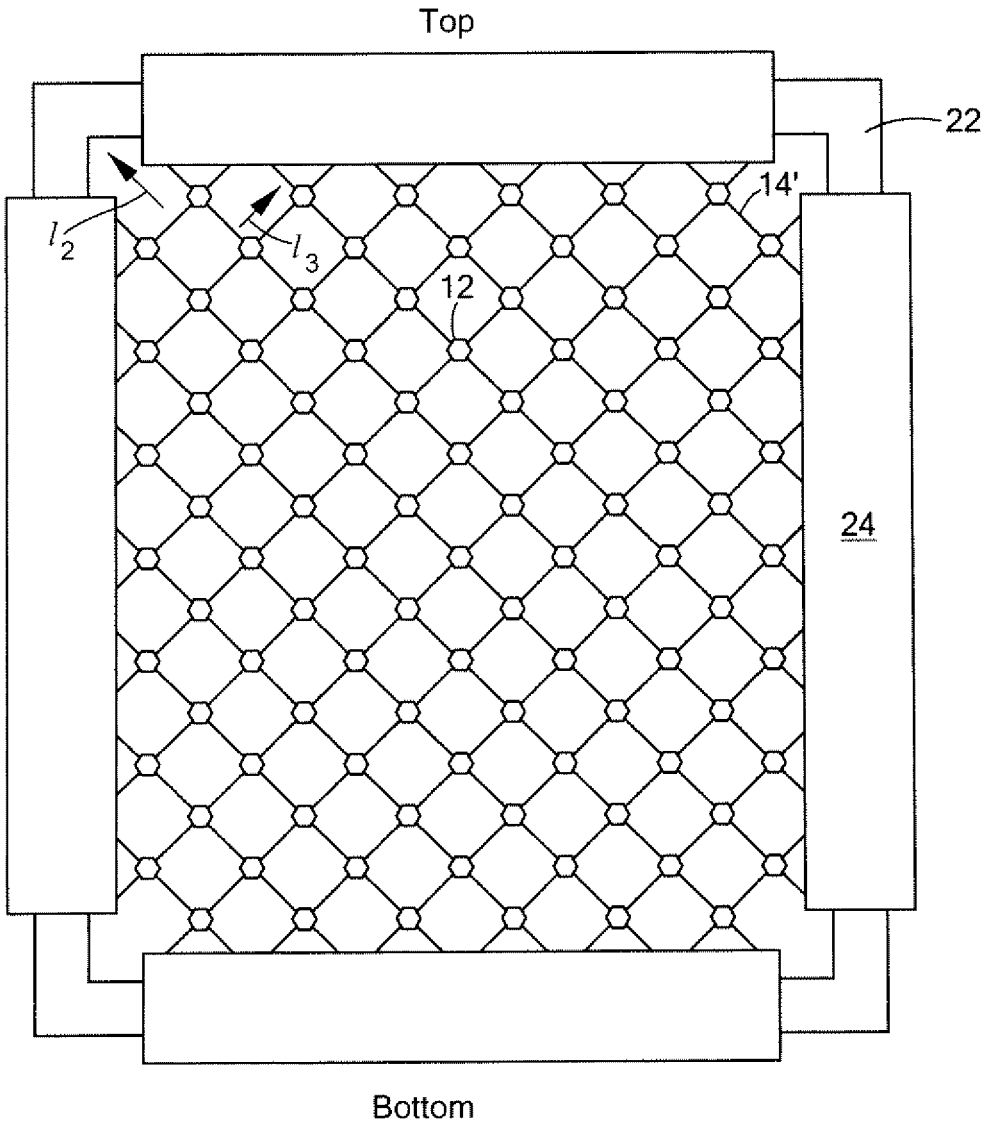
FIG. 17 is a schematic front view showing still another embodiment of an ordinance shield subsystem in accordance with the subject invention.
Figure 18:
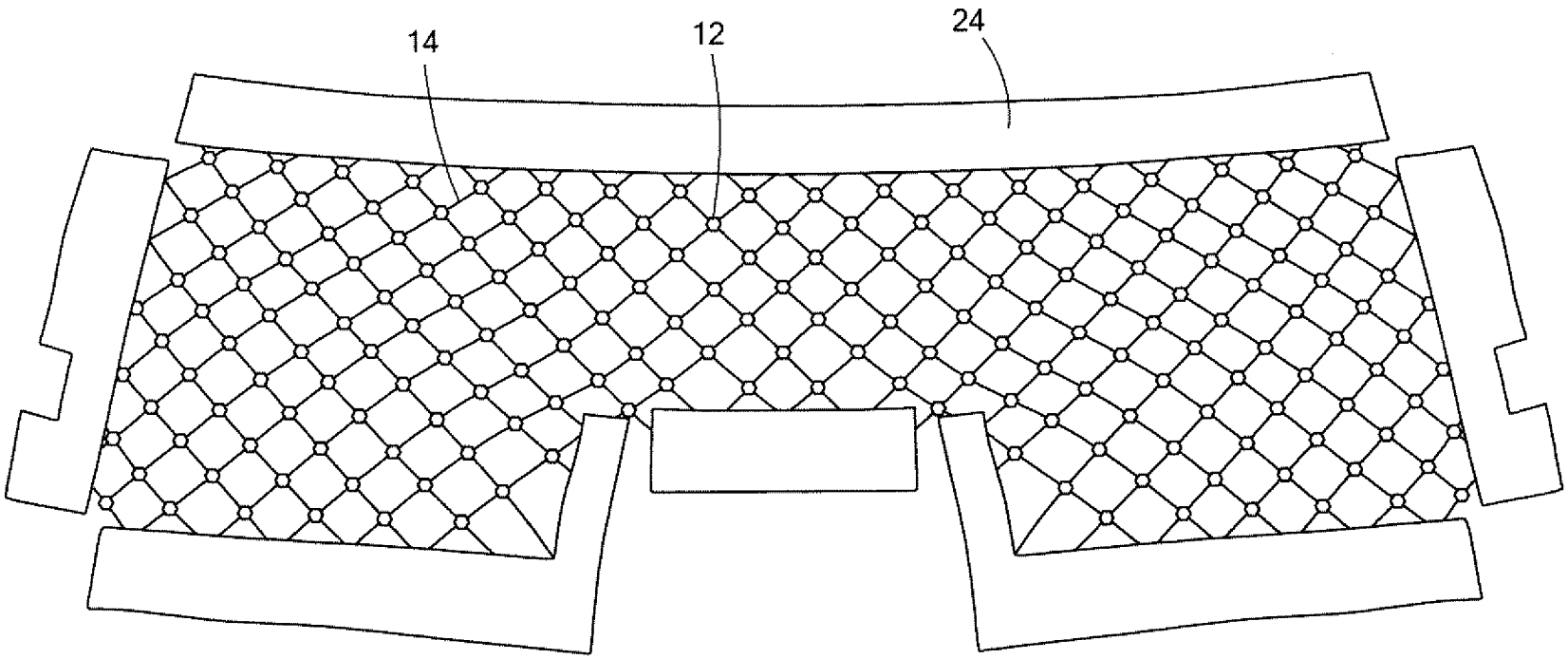
FIG. 18 is another view of the net subsystem shown in FIG. 17.

FIGS. 17 and 18 show a new option wherein net 14' is made of diagonally extending intersecting lines (biased 45°, for example) as shown for lines 302 and 304 resulting in diamond shaped openings and strands which share the load due to the weight of the hard point(s). Typically, loads $l_2$ and $l_3$ are each less than $l_1$, FIG. 16. The result is less likely breakage of lines 302 and 304 in the field for a given line strength as specified above. Also, surprisingly, the hard points 12, in this net design, oscillated less (during vibration testing) resulting in a ten times improvement in performance. The overall effectiveness of the net with diagonally extending intersecting lines connected at nodes received in the hard points is approximately the same as the vertically and horizontally extending designs discussed above but the net shown in FIGS. 17 and 18 prove to be much more durable. The same net material, mesh size, hard point design, and the like may be used as the designs discussed above, e.g., line 302 is between 55 and 95 mm long. Also, diagonally extending and intersecting lines as shown in FIGS. 17 and 18 prevent the illusion that a trip wire or the like is across the road as was sometimes the case with the design of FIG. 16 attached to a vehicle in a soldier's line of sight.

Figure 19:
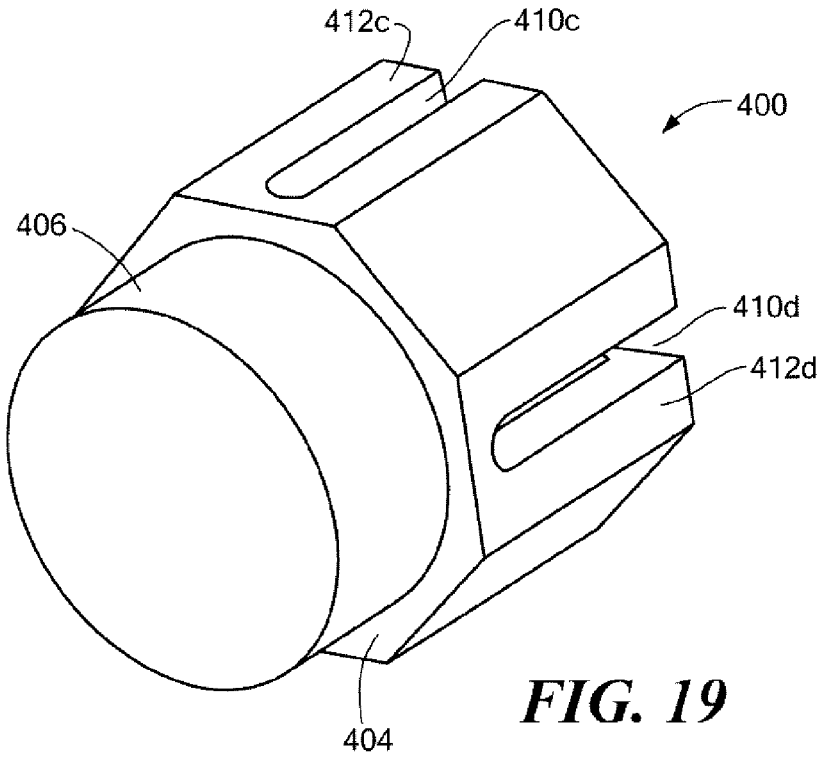
FIG. 19 is a schematic three dimensional front view showing an example of an improved hard point in accordance with an example of the invention.
Figure 20:
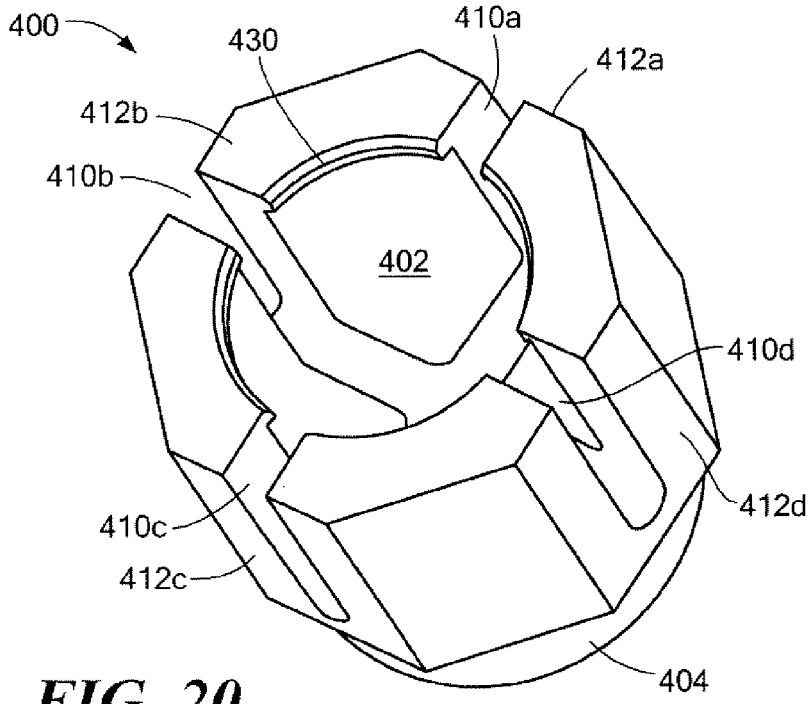
FIG. 20 is a schematic three dimensional rear view of the hard point shown in FIG. 19.
Figure 21:
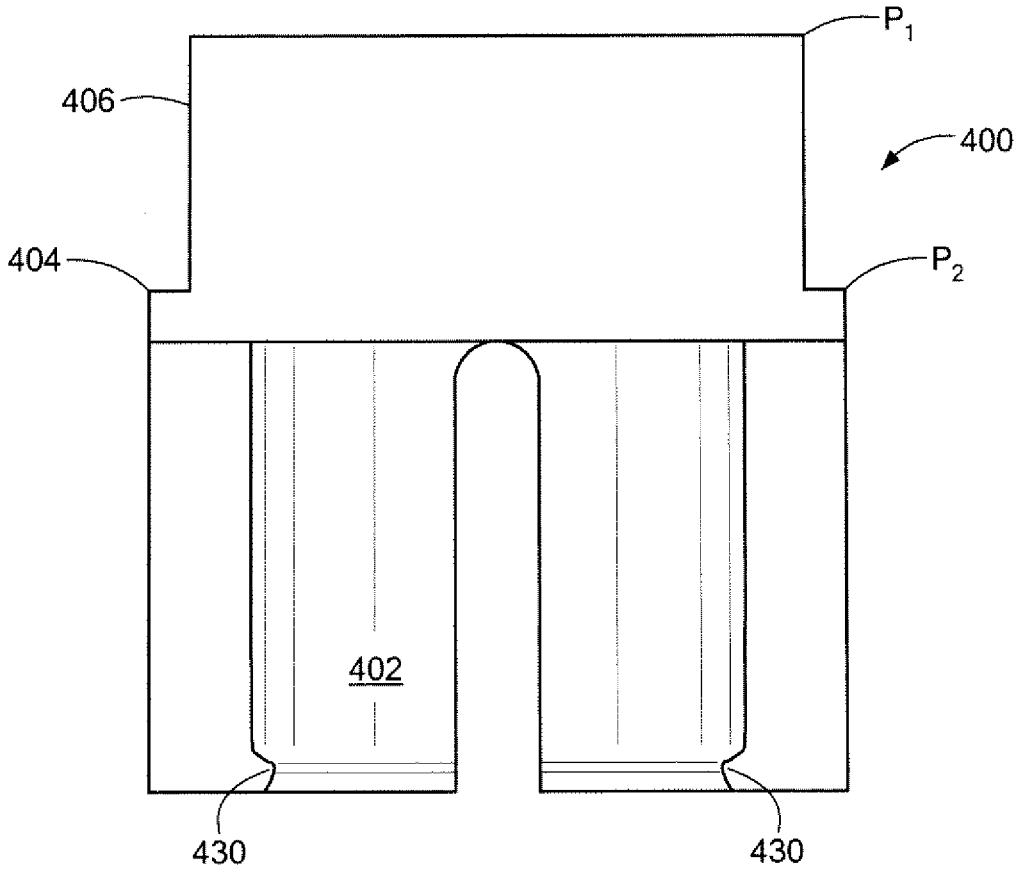
FIG. 21 is a schematic cross sectional view of the hard point shown in FIGS. 19 and 20.

In one preferred embodiment, a stepped hard point includes multi-sided body 400, FIGS. 19-21 with a cavity 402 therein behind front face 404. Protrusion portion 406 extends outwardly from front face 404 resulting in multiple threat contact points $P_1$ and $P_2$, FIG. 21 (for a threat at 90°) increasing the effectiveness of the system. Such a hard point can be machined from a piece of metal. Other stepped body designs are possible.

Figure 22:
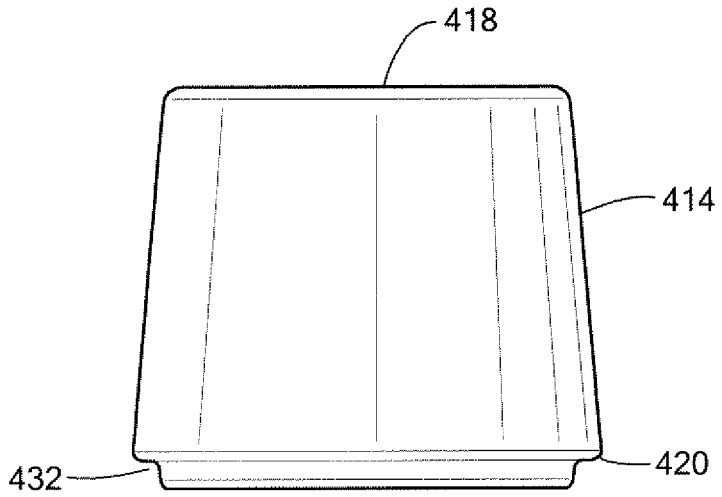
FIG. 22 is a schematic three dimensional front view of the plug portion of an improved hard point as depicted in FIGS. 19-21.
Figure 23:
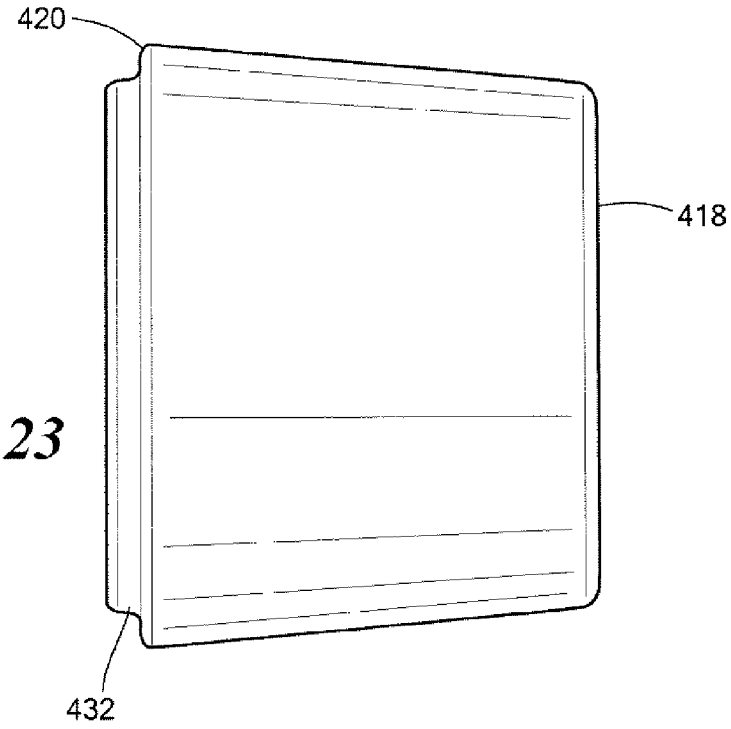
FIG. 23 is a schematic side view of the tapered plug shown in FIG. 22.

As before, a net node is placed in cavity 402, the lines of the net extend through slots 410*a*-410*d* in walls 412*a*-412*d*, respectively, and plug 414, FIGS. 22-23, is then pressed into cavity 402, FIGS. 19-21 locking the net node in the cavity and securing the hard point to the node in a pivotable fashion whereupon contact points $P_1$ and/or $P_2$ are able to strike and dig into the ogive skin of an RPG. Note that if contact point $P_2$ first contacts the ogive's skin, the result is that the hard point turns inward on the net and now contact point $P_1$ may engage the ogive skin.

In some preferred examples, protrusion 406 is cylindrical in shape and has a diameter which spans the majority of face 404. In one example, the protrusion was a solid cylindrical portion 0.600 inches in diameter and 0.250 inches long. Face 404 was 0.688 inches across. The hard point was 0.743 inches tall and thus had a length to diameter ratio of approximately 1 which increased the effectiveness of the system. Body 400 had eight sides as shown rendering it symmetrical for ease of assembly since every other wall has a slot (410*a*-410*d*) in its middle. A symmetrical shape also increases the effectiveness of the hard points and now there are eight sharp edges available to dig into the ogive skin. Solid plug 414 tapers as shown in FIGS. 22-23 from a distal surface 418 which is 0.425 inches in diameter to a proximal surface 420 which is 0.495 inches in diameter. The taper renders assembly easier. A non-tapered plug (see FIG. 7) may also be used.

To better and more reliably and positively retain a plug 414, FIGS. 22-23 in cavity 402, FIGS. 20-21, body 400 may include, in this design, optional proximal lip 430 extending in to cavity 412 and plug 414, FIGS. 22-23 includes reduced diameter proximal portion 432 defining ledge 420 engaged by lip 430, FIGS. 20-21. This design also makes quality assurance inspections easier. Lip 430, in other examples, is not included.

When a vehicle such as vehicle 20', FIG. 13 is equipped with one or frames 16 and traverses rough terrain, narrow corridors, or is engaged in other maneuvers (as is typical with respect to military vehicles), one or more frame members 130 may be damaged.

Figure 24:
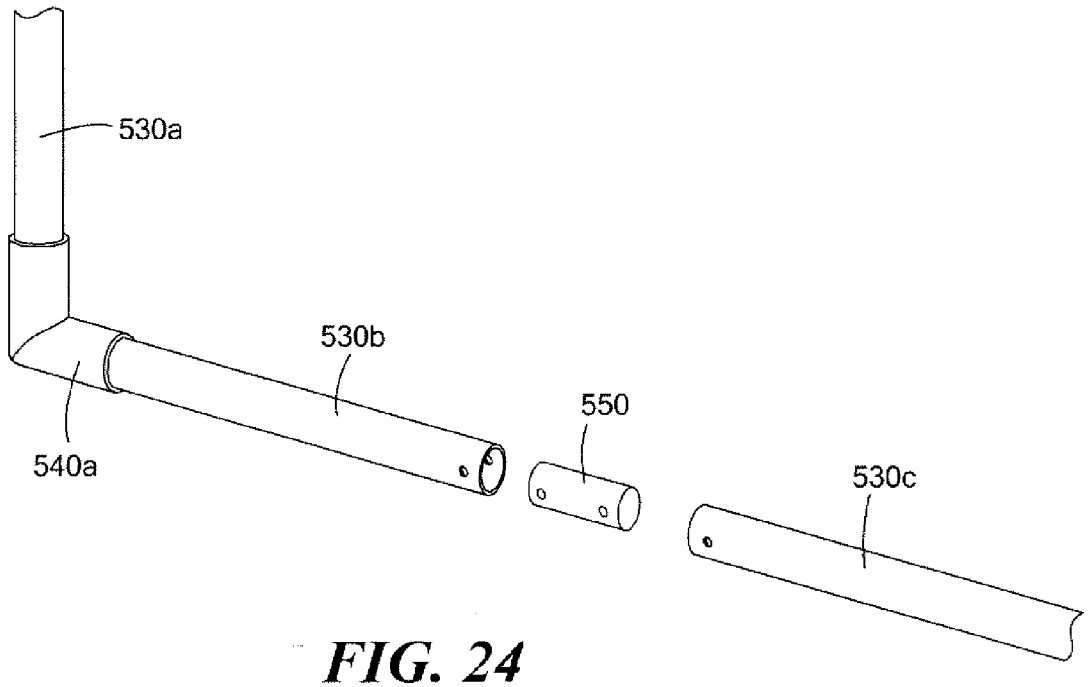
FIG. 24 is a schematic view showing a portion of protection system frame in accordance with an example of the invention.

FIG. 24 shows frame tubular members 530*a* and 530*b* coupled together by corner member 540*a* forming, in this particular example, the lower left hand corner of a net frame. Member 530*b* is adjacent member 530*c* (which may extend to the lower right hand corner of the frame). All the members are typically hollow aluminum tubes with a 2.5 inch wall thickness in this particular example.

Adjacent tubular members 530*b* and 530*c* are coupled together via flexure 550, in this example a solid rubber rod inserted into members 530*b* and 530*c* and secured thereto using fasteners, for example pins, in the holes shown. In addition or instead, corner member 530*a* could be a flexure.

Figure 25A:
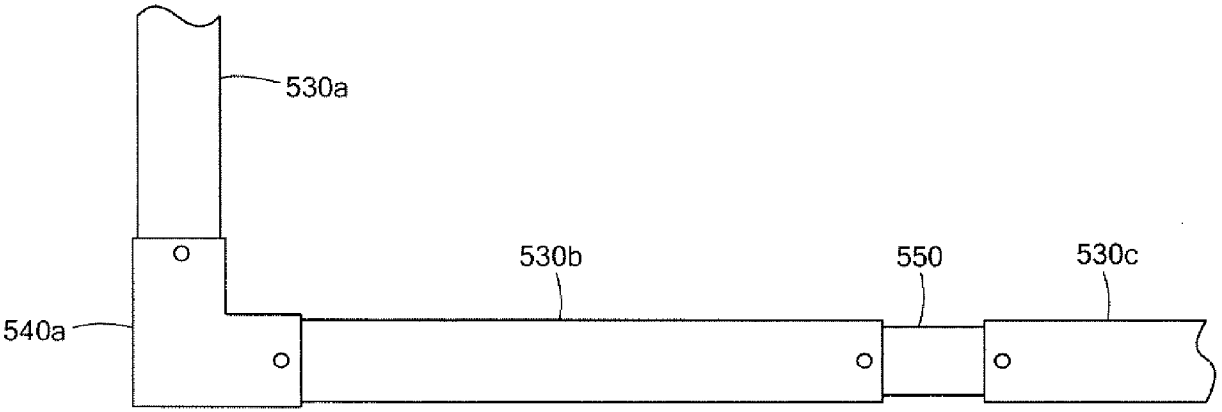
FIGS. 25A and 25B show the frame members assembled and deflecting by virtue of the incorporation of a flexure in accordance with one example of the invention.
Figure 25B:
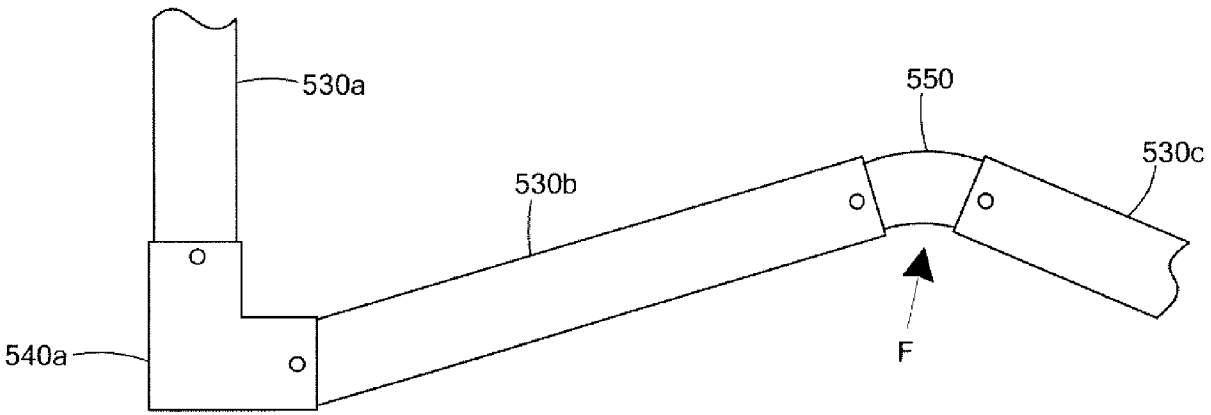
Figure 26:
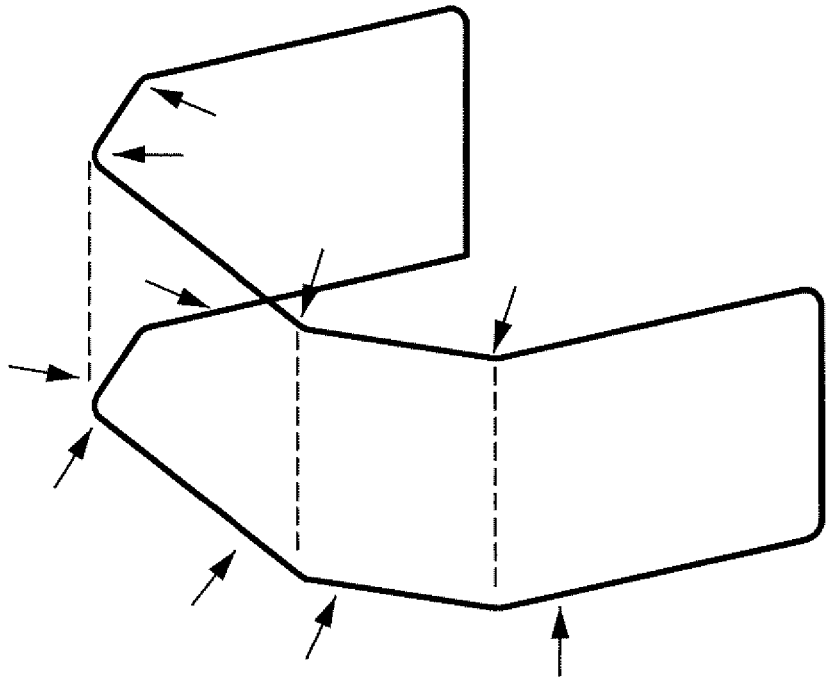
FIG. 26 is a schematic depiction of another protection system frame annotated to depict the location of flexures in one particular frame design.

FIG. 25 shows how, when a force F (a rock, hydrant, or building corner) is applied to the frame, flexure 550 allows the frame members 530*b* and 530*c* to deflect. After force F is removed, the flexure returns members 530*b* and 530*c* to their original orientation (e.g., in-line). FIG. 26 shows a frame design for the front of one particular military vehicle and the arrows depict where flexures may be installed. The frame may support the hard point net previously disclosed, a net without hard points (see, for example, U.S. Pat. No. 7,866,250 incorporated herein by this reference), and/or another type of RPG defeat subsystem.

Figure 27:
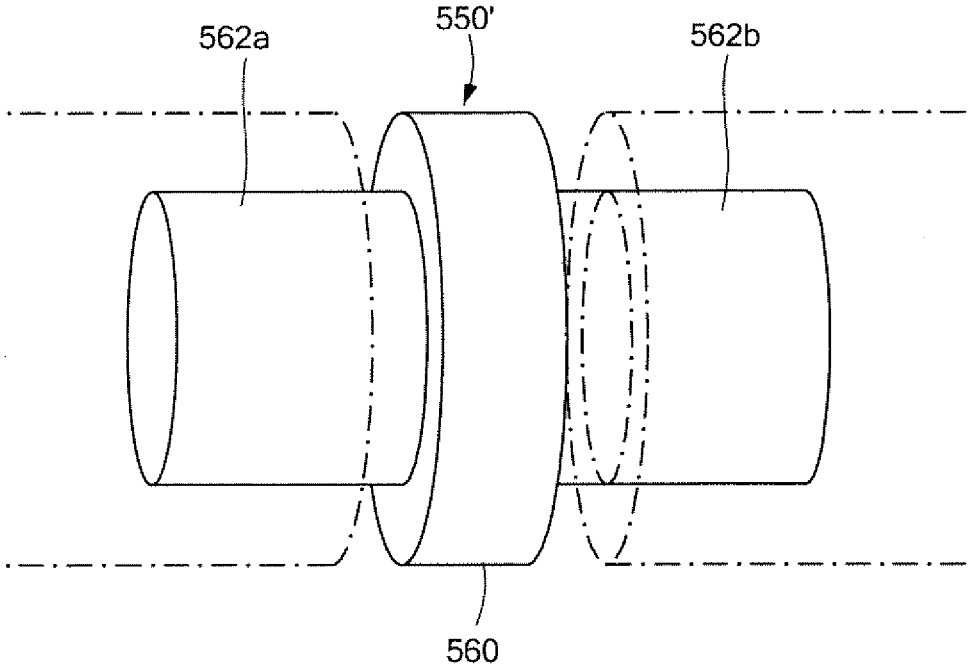
FIG. 27 is a schematic view showing another example of a flexure.

FIG. 27 shows a flexure design for flexure 550' between two tubular members (shown in phantom). Collar 560 has male plugs 562*a* and 562*b* extending outwardly from each side thereof. The plugs are received inside the ends of adjacent frame members.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A protection system comprising:

a net with lines connected at nodes;

hard points attached to at least select nodes; and a frame supporting the net and positioning it in a spaced relationship with respect to a vehicle or structure, the frame including:

tubular members, and select adjacent tubular members connected via a flexure configured to prevent damage to the frame when impacted.

2. The protection system of claim 1 in which the adjacent tubular members are hollow and the flexure is a rod inserted into the hollow tubular member.

3. The protection system of claim 2 in which the rod is made of rubber.

4. The protection system of claim 2 in which the rod is fastened to each hollow tube member.

5. The protection system of claim 1 in which the select adjacent tubular members are at the bottom of the frame.

6. The protection system of claim 1 in which the adjacent tubular members are oriented in the same direction and the flexure is straight.

7. The protection system of claim 1 in which the adjacent tubular members are at a right angle to each other and the flexure is angled.

8. The protection system of claim 1 in which the net includes low breaking strength intersecting lines.

9. The protection system of claim 1 in which a hard point includes a multi-sided body with a cavity therein behind the front face thereof and a plug received in the cavity locking a net node in the cavity and securing the hard point to the net in a pivotable fashion.

10. The protection system of claim 9 in which the hard point body has eight sides.

11. The protection system of claim 10 in which four sides include slots receiving net lines therein.

12. The protection system of claim 9 in which the plug is tapered.

13. The protection system of claim 9 in which the hard point body includes a lip extending into the cavity locking the plug therein.

14. The protection system of claim 9 in which the plug is press fit into the cavity.

15. The protection system of claim 1 in which the net has a mesh between 110 and 190 mm.

16. The protection system of claim 13 in which the plug includes a ledge engaged by the lip.

17. The protection system of claim 1 in which the hard point has a length to diameter ratio of approximately 1.

18. The protection system of claim 1 in which the net lines have a breaking strength such that a line will break upon impact of an ordinance fuse with the line for a predetermined percentage of ordinance fuse impacts.

19. The protection system of claim 18 in which the predetermined percent is 100 percent.

20. The protection system of claim 18 in which the predetermined percentage is between 80 and 100%.

21. The protection system of claim 1 in which the net material has a breaking strength of between 100 lbs and 1.500 lbs.

22. The protection system of claim 1 in which the hard points include steel.

23. The protection system of claim 1 in which each hard point weighs between 10 and 80 grams.

24. The protection system of claim 1 in which the net line has a diameter of between 1.7 and 1.9 mm.

25. A protection system comprising:

a flexible subsystem including spaced hard points; and a frame supporting the flexible subsystem and positioning it in a spaced relationship with respect to a vehicle or structure, the frame including:

tubular members, and select adjacent tubular members connected via a flexure configured to prevent damage to the frame when impacted.

26. The protection subsystem of claim 25 in which the flexible subsystem includes a net with lines defining nodes for the hard points.

27. A protection system comprising:

an RPG protection subsystem; and a frame supporting the RPG protection subsystem and positioning it in a spaced relationship with respect to a vehicle or structure, the frame including:

tubular members, and select adjacent tubular members connected via a flexure configured to prevent damage to the frame when impacted.

28. The protection system of claim 27 in which the RPG protection subsystem includes a net with lines connected at nodes.

29. The protection system of claim 28 in which the RPG protection subsystem further includes hard points attached to at least select nodes.

* * * * *